US011264734B2

(12) United States Patent
Lee et al.

(10) Patent No.: US 11,264,734 B2
(45) Date of Patent: Mar. 1, 2022

(54) ANTENNA AND ELECTRONIC DEVICE INCLUDING SAME

(71) Applicant: Samsung Electronics Co., Ltd., Suwon-si (KR)

(72) Inventors: Sungyoung Lee, Suwon-si (KR); Sanghun Park, Suwon-si (KR); Gunwoo Lee, Suwon-si (KR); Jongjoo Je, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 8 days.

(21) Appl. No.: 16/971,526

(22) PCT Filed: Jul. 31, 2020

(86) PCT No.: PCT/KR2020/010157

§ 371 (c)(1),
(2) Date: Aug. 20, 2020

(87) PCT Pub. No.: WO2021/025393

PCT Pub. Date: Feb. 11, 2021

(65) Prior Publication Data

US 2021/0218128 A1 Jul. 15, 2021

(30) Foreign Application Priority Data

Aug. 2, 2019 (KR) ..... 10-2019-0094589

(51) Int. Cl.
*H01Q 1/24* (2006.01)
*H01Q 1/42* (2006.01)
(Continued)

(52) U.S. Cl.
CPC ..... *H01Q 21/08* (2013.01); *H01Q 1/243* (2013.01); *H01Q 1/38* (2013.01); *H01Q 21/062* (2013.01); *H01Q 21/065* (2013.01)

(58) Field of Classification Search
CPC ..... H01Q 1/24; H01Q 1/243; H01Q 5/307; H01Q 9/0407; H01Q 1/12; H01Q 1/1221;
(Continued)

(56) References Cited

U.S. PATENT DOCUMENTS 10,003,679 B2 6/2018 Lee et al.
10,386,790 B2 8/2019 Katsuda et al.
(Continued)

FOREIGN PATENT DOCUMENTS

JP 2018-105666 A 7/2018
KR 10-2010-0076452 A 7/2010
(Continued)

OTHER PUBLICATIONS

International Search Report dated Nov. 10, 2020, issued in International Application No. PCT/KR2020/010157.

*Primary Examiner* — Thai Pham
(74) *Attorney, Agent, or Firm* — Jefferson IP Law, LLP

(57) ABSTRACT

According to various embodiments, an electronic device may include: a housing including a side member including a conductive member and a non-conductive member coupled with the conductive member; and at least one antenna structure disposed in an internal space of the housing and including a substrate disposed to face the side member, and at least one antenna element which is disposed on the substrate such that a beam pattern is formed through the non-conductive member in a direction in which the side member faces, wherein: when the side member is viewed from the outside, a boundary region between the conductive member and the non-conductive member is disposed in a region not overlapping the substrate; in the boundary region, the conductive member includes at least one concave part formed to at least partially receive the non-conductive member; and the at least one concave part includes two or more stepped parts which gradually get higher or lower as
(Continued)

the stepped parts are further leftward or rightward from the substrate, when the side member is viewed from the outside.

15 Claims, 22 Drawing Sheets

(51) Int. Cl.
*H01Q 21/08* (2006.01)
*H01Q 1/38* (2006.01)
*H01Q 21/06* (2006.01)

(58) Field of Classification Search
CPC ..... H01Q 1/2283; H01Q 1/2291; H01Q 1/38; H01Q 1/42; H01Q 21/062; H01Q 21/065; H01Q 21/08; H01Q 21/28
See application file for complete search history.

(56) References Cited

U.S. PATENT DOCUMENTS

| | | | | |
|---|---|---|---|---|
| 2014/0347227 | A1 | 11/2014 | Iellici et al. | |
| 2018/0026341 | A1 | 1/2018 | Mow et al. | |
| 2018/0241115 | A1* | 8/2018 | Cho | H01Q 1/38 |
| 2018/0358686 | A1* | 12/2018 | Park | H01Q 1/2283 |
| 2019/0104212 | A1 | 4/2019 | Lee et al. | |
| 2019/0165454 | A1 | 5/2019 | Lee et al. | |
| 2020/0259251 | A1* | 8/2020 | Seo | H01Q 15/08 |
| 2020/0365973 | A1* | 11/2020 | Jeon | H01Q 9/0407 |

FOREIGN PATENT DOCUMENTS

| | | | |
|---|---|---|---|
| KR | 10-2016-0019833 | A | 2/2016 |
| KR | 10-1898059 | B1 | 10/2018 |
| KR | 10-2018-0134528 | A | 12/2018 |
| KR | 10-2019-0061161 | A | 6/2019 |

* cited by examiner

ANTENNA AND ELECTRONIC DEVICE INCLUDING SAME

TECHNICAL FIELD

Various embodiments provide an antenna and an electronic device including the same.

BACKGROUND ART

With the development of wireless communication technology, an electronic device (e.g., an electronic device for communication) is commonly used in daily life, and accordingly, the use of content is increasing exponentially. Due to the rapid increase in the use of content, network capacity is gradually reaching its limit, and after commercialization of a 4th generation (4G) communication system, a communication system (e.g., a 5th generation (5G) or pre-5G communication system, or a new radio (NR) communication system) which transmits and/or receives a signal by using a frequency in a high frequency (e.g., mmWave) band (e.g., 3 GHz to 300 GHz band) has been studied in order to satisfy an increasing demand for wireless data traffic.

DETAILED DESCRIPTION OF INVENTION

Technical Problem

According to next-generation wireless communication technology, an efficient mounting structure, which enables use of a frequency in the range of substantially 3 GHz to 100 GHz for transmission and/or reception of a wireless signal and is capable of overcoming high free-space loss according to frequency characteristics and increasing the gain of an antenna, and a new antenna corresponding thereto are being developed. The antenna may include an antenna structure in the form of an array in which various numbers of antenna elements (e.g., conductive patches or conductive patterns) are arranged at predetermined intervals. Such antenna elements may be arranged such that a beam pattern is formed in one direction in an internal space of an electronic device. For example, the antenna structure may be arranged in the internal space of the electronic device such that a beam pattern is formed toward a direction in which at least a portion of a front surface, a rear surface, and/or a side surface of the antenna structure faces.

An electronic device may include a conductive member (e.g., a metal member) disposed in at least a portion of a housing (e.g., a housing structure) to reinforce rigidity and form a beautiful external appearance, and a non-conductive member (e.g., a polymer or injection-molded material) coupled with the conductive member. Such a housing may be formed as an integral structure through insert-injection of the non-conductive member into the conductive member or structural coupling between the non-conductive member and the conductive member.

However, when such a conductive member is disposed near an antenna structure, radiation performance of an antenna may be deteriorated, and radiation sensitivity thereof may be degraded. In addition, coupling portions of the conductive member and the non-conductive member may be separated from each other or dislocated by external impact, so as to degrade the product reliability.

Solution to Problem

Various embodiments may provide an antenna and an electronic device including the same.

Various embodiments may provide an antenna which can prevent deterioration of antenna radiation performance through a structural change of a housing, and an electronic device including the antenna.

Various embodiments may provide an antenna which can prevent damage to a housing due to external impact and prevent deterioration of antenna performance, and an electronic device including the antenna.

According to various embodiments, an electronic device may include: a housing including a side member including a conductive member and a non-conductive member coupled with the conductive member; and at least one antenna structure disposed in an internal space of the housing and including a substrate and at least one antenna element, the substrate being disposed to face the side member, and the at least one antenna element being disposed on the substrate and having a beam pattern formed through the non-conductive member, wherein: when the side member is viewed from the outside, a boundary region between the conductive member and the non-conductive member is disposed in a region not overlapping the substrate; in the boundary region, the conductive member includes at least one concave part formed to at least partially receive the non-conductive member; and the at least one concave part includes two or more stepped parts which gradually get higher or lower as the stepped parts are further leftward or rightward from the substrate, when the side member is viewed from the outside.

Various respective aspects and features of the invention are defined in the appended claims. Combinations of features from the dependent claims may be combined with features of the independent claims as appropriate and not merely as explicitly set out in the claims.

Furthermore, one or more selected features of any one embodiment described in this disclosure may be combined with one or more selected features of any other embodiment described herein, provided that the alternative combination of features at least partially alleviates the one or more technical problem discussed in this disclosure or at least partially alleviates a technical problem discernible by the skilled person from this disclosure and further provided that the particular combination or permutation of embodiment features thus formed would not be understood by the skilled person to be incompatible.

Two or more physically distinct components in any described example implementation of this disclosure may alternatively be integrated into a single component where possible, provided that the same function is performed by the single component thus formed. Conversely, a single component of any embodiment described in this disclosure may alternatively be implemented as two or more distinct components to achieve the same function, where appropriate.

It is an aim of certain embodiments of the invention to solve, mitigate or obviate, at least partly, at least one of the problems and/or disadvantages associated with the prior art. Certain embodiments aim to provide at least one of the advantages described below.

Advantageous Effects of Invention

An electronic device according to exemplary embodiments can prevent a phenomenon in which a non-conductive member is separated from a conductive member of a housing due to external impact, through a structural change of the housing, and can help to improve radiation performance of an antenna while maintaining rigidity.

BRIEF DESCRIPTION OF DRAWINGS

For a more complete understanding of the disclosure and its advantages, reference is now made to the following description taken in conjunction with the accompanying drawings, in which like reference numerals represent like parts.

MODE FOR THE INVENTION

Figure 1:
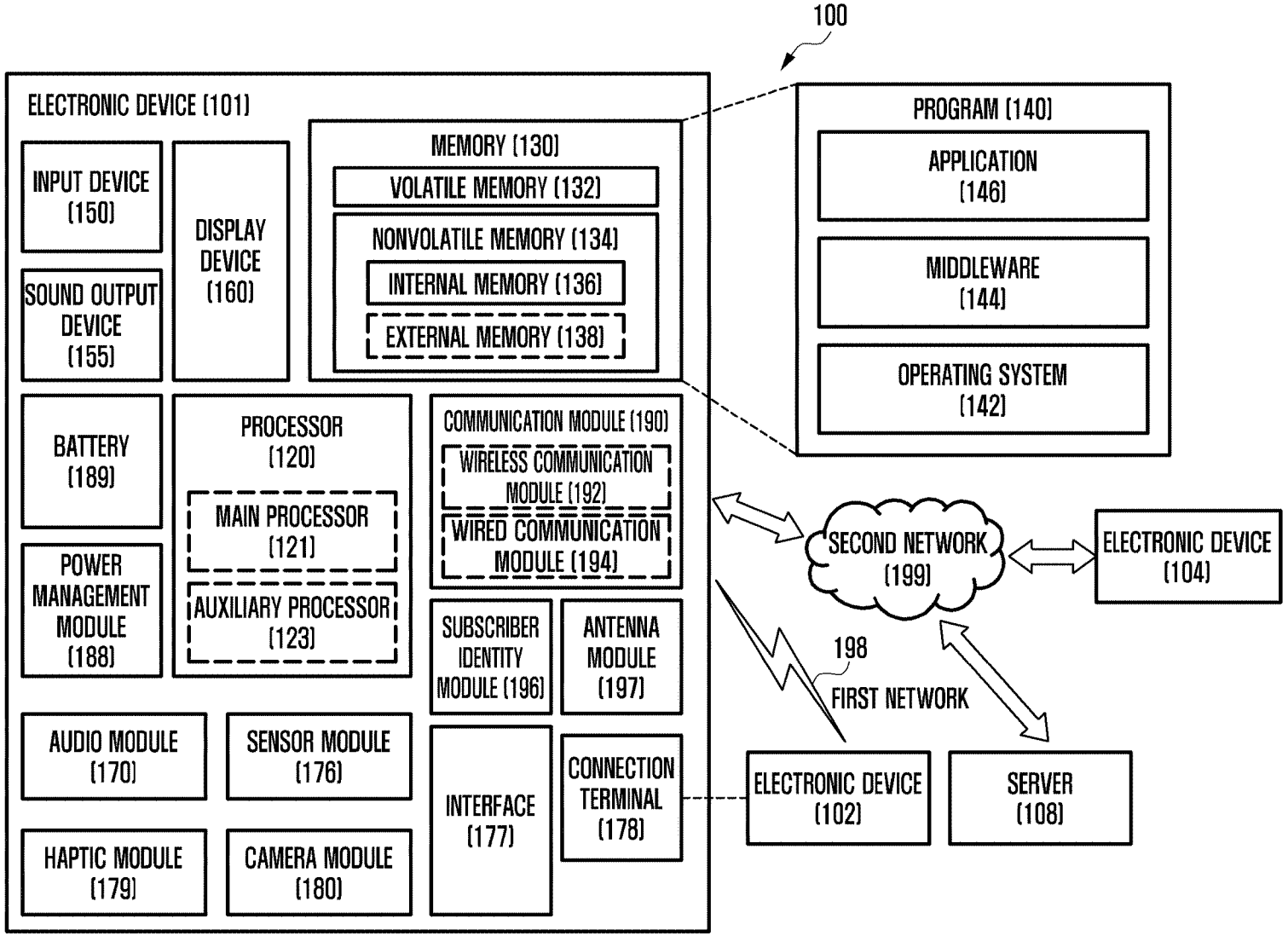
FIG. 1 is a block diagram of an electronic device in a network environment according to various embodiments.

FIG. 1 illustrates an electronic device in a network environment according to an embodiment of the disclosure.

Referring to FIG. 1, an electronic device 101 in a network environment 100 may communicate with an electronic device 102 via a first network 198 (e.g., a short-range wireless communication network), or an electronic device 104 or a server 108 via a second network 199 (e.g., a long-range wireless communication network). The electronic device 101 may communicate with the electronic device 104 via the server 108. The electronic device 101 includes a processor 120, memory 130, an input device 150, an audio output device 155, a display device 160, an audio module 170, a sensor module 176, an interface 177, a haptic module 179, a camera module 180, a power management module 188, a battery 189, a communication module 190, a subscriber identification module (SIM) 196, and/or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. As at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. The processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). The auxiliary processor 123 (e.g., an ISP or a CP) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134, and the non-volatile memory may include one or more of an internal memory 136 and external memory 138.

The program 140 may be stored in the memory 130 as software, and may include, for example, an operating system (OS) 142, middleware 144, and/or an application 146.

The input device 150 may receive a command or data to be used by other components (e.g., the processor 120) of the electronic device 101, from the outside (e.g., a user) of the electronic device 101. The input device 150 may include, for example, a microphone, a mouse, a keyboard, or a digital pen (e.g., a stylus pen).

The audio output device 155 may output sound signals to the outside of the electronic device 101. The audio output device 155 may include, for example, a speaker or a receiver. The speaker may be used for general purposes, such as playing multimedia or playing record, and the receiver may be used for incoming calls. The receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. The display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. The audio module 170 may obtain the sound via the input device 150, or output the sound via the audio output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. The sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. The interface 177 may include, for example, a high definition multimedia interface (HDMI), a universal serial bus (USB) interface, a secure digital (SD) card interface, or an audio interface.

A connection terminal 178 may include a connector via which the electronic device 101 may be physically connected with the external electronic device (e.g., the electronic device 102). The connection terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. The haptic module 179 may include, for example, a motor, a piezoelectric element, or an electric stimulator.

The camera module 180 may capture an image or moving images. The camera module 180 may include one or more lenses, image sensors, image signal processors, or flashes.

The power management module 188 may manage power supplied to the electronic device 101. The power management module 188 may be implemented as at least part of, for example, a power management integrated circuit (PMIC).

The battery 189 may supply power to at least one component of the electronic device 101. The battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the AP) and supports a direct (e.g., wired) communication or a wireless communication. The communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the SIM 196.

The antenna module 197 may transmit or receive a signal or power to or from the outside (e.g., the external electronic device) of the electronic device 101. The antenna module 197 may include an antenna including a radiating element composed of a conductive material or a conductive pattern formed in or on a substrate (e.g., a printed circuit board (PCB)). The antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. Another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

Commands or data may be transmitted or received between the electronic device 101 and the external electronic device 104 via the server 108 coupled with the second network 199. Each of the electronic devices 102 and 104 may be a device of a same type as, or a different type, from the electronic device 101. All or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

An electronic device according to an embodiment may be one of various types of electronic devices. The electronic device may include a portable communication device (e.g., a smart phone), a computer device, a portable multimedia device, a portable medical device, a camera, a wearable device, or a home appliance. However, the electronic device is not limited to any of those described above.

Various embodiments of the disclosure and the terms used herein are not intended to limit the technological features set forth herein to particular embodiments and include various changes, equivalents, or replacements for a corresponding embodiment. With regard to the description of the drawings, similar reference numerals may be used to refer to similar or related elements. A singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C" may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). If an element (e.g., a first element) is referred to, with or without the term "operatively" or "communicatively," as "coupled with," "coupled to," "connected with," or "connected to" another element (e.g., a second element), it means that the element may be coupled with the other element directly (e.g., wiredly), wirelessly, or via a third element.

The term "module" may include a unit implemented in hardware, software, or firmware, and may interchangeably be used with other terms, for example, "logic," "logic block," "part," or "circuitry." A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., the internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

A method according to an embodiment of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

Each component (e.g., a module or a program) of the above-described components may include a single entity or multiple entities. One or more of the above-described components may be omitted, or one or more other components may be added. Alternatively or additionally, a plurality of components (e.g., modules or programs) may be integrated into a single component. In such a case, the integrated component may perform one or more functions of each of the plurality of components in the same or similar manner as they are performed by a corresponding one of the plurality of components before the integration. Operations performed by the module, the program, or another component may be carried out sequentially, in parallel, repeatedly, or heuristically, or one or more of the operations may be executed in a different order or omitted, or one or more other operations may be added.

Figure 2:
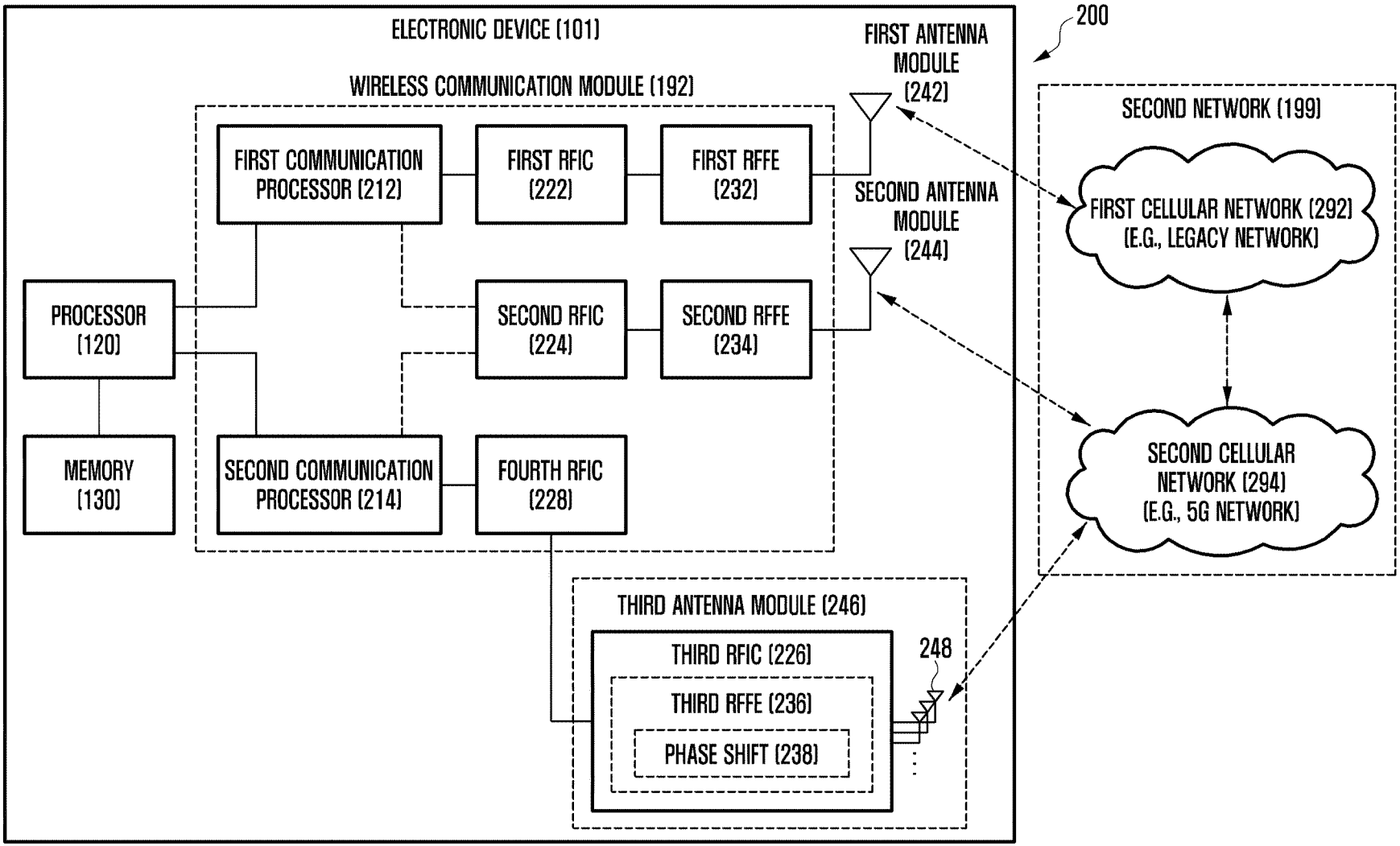
FIG. 2 is a block diagram of an electronic device for supporting legacy network communication and 5G network communication according to various embodiments.

FIG. 2 is a block diagram illustrating an electronic device in a network environment including a plurality of cellular networks according to an embodiment of the disclosure.

Referring to FIG. 2, the electronic device 101 of block diagram 200 may include a first communication processor 212, second communication processor 214, first RFIC 222, second RFIC 224, third RFIC 226, fourth RFIC 228, first radio frequency front end (RFFE) 232, second RFFE 234, first antenna module 242, second antenna module 244, and antenna 248. The electronic device 101 may include the processor 120 and the memory 130. A second network 199 may include a first cellular network 292 and a second cellular network 294. According to another embodiment, the electronic device 101 may further include at least one of the components described with reference to FIG. 1, and the second network 199 may further include at least one other network. According to one embodiment, the first communication processor 212, second communication processor 214, first RFIC 222, second RFIC 224, fourth RFIC 228, first RFFE 232, and second RFFE 234 may form at least part of the wireless communication module 192. According to another embodiment, the fourth RFIC 228 may be omitted or included as part of the third RFIC 226.

The first communication processor 212 may establish a communication channel of a band to be used for wireless communication with the first cellular network 292 and support legacy network communication through the established communication channel. According to various embodiments, the first cellular network may be a legacy network including a second generation (2G), 3G, 4G, or long-term evolution (LTE) network. The second communication processor 214 may establish a communication channel corresponding to a designated band (e.g., about 6 GHz to about 60 GHz) of bands to be used for wireless communication with the second cellular network 294, and support 5G network communication through the established communication channel According to various embodiments, the second cellular network 294 may be a 5G network defined in 3GPP. Additionally, according to an embodiment, the first communication processor 212 or the second communication processor 214 may establish a communication channel corresponding to another designated band (e.g., about 6 GHz or less) of bands to be used for wireless communication with the second cellular network 294 and support 5G network communication through the established communication channel According to one embodiment, the first communication processor 212 and the second communication processor 214 may be implemented in a single chip or a single package. According to various embodiments, the first communication processor 212 or the second communication processor 214 may be formed in a single chip or a single package with the processor 120, the auxiliary processor 123, or the communication module 190.

Upon transmission, the first RFIC 222 may convert a baseband signal generated by the first communication processor 212 to a radio frequency (RF) signal of about 700 MHz to about 3 GHz used in the first cellular network 292 (e.g., legacy network). Upon reception, an RF signal may be obtained from the first cellular network 292 (e.g., legacy network) through an antenna (e.g., the first antenna module 242) and be preprocessed through an RFFE (e.g., the first RFFE 232). The first RFIC 222 may convert the preprocessed RF signal to a baseband signal so as to be processed by the first communication processor 212.

Upon transmission, the second RFIC 224 may convert a baseband signal generated by the first communication processor 212 or the second communication processor 214 to an RF signal (hereinafter, 5G Sub6 RF signal) of a Sub6 band (e.g., 6 GHz or less) to be used in the second cellular network 294 (e.g., 5G network). Upon reception, a 5G Sub6 RF signal may be obtained from the second cellular network 294 (e.g., 5G network) through an antenna (e.g., the second antenna module 244) and be pretreated through an RFFE (e.g., the second RFFE 234). The second RFIC 224 may convert the preprocessed 5G Sub6 RF signal to a baseband signal so as to be processed by a corresponding communication processor of the first communication processor 212 or the second communication processor 214.

The third RFIC 226 may convert a baseband signal generated by the second communication processor 214 to an RF signal (hereinafter, 5G Above6 RF signal) of a 5G Above6 band (e.g., about 6 GHz to about 60 GHz) to be used in the second cellular network 294 (e.g., 5G network). Upon reception, a 5G Above6 RF signal may be obtained from the second cellular network 294 (e.g., 5G network) through an antenna (e.g., the antenna 248) and be preprocessed through a third RFFE 236. The third RFIC 226 may convert the preprocessed 5G Above6 RF signal to a baseband signal so as to be processed by the second communication processor 214. According to one embodiment, the third RFFE 236 may be formed as part of the third RFIC 226.

According to an embodiment, the electronic device 101 may include a fourth RFIC 228 separately from the third RFIC 226 or as at least part of the third RFIC 226. In this case, the fourth RFIC 228 may convert a baseband signal generated by the second communication processor 214 to an RF signal (hereinafter, an intermediate frequency (IF) signal) of an intermediate frequency band (e.g., about 9 GHz to about 11 GHz) and transfer the IF signal to the third RFIC 226. The third RFIC 226 may convert the IF signal to a 5G Above 6RF signal. Upon reception, the 5G Above 6RF signal may be received from the second cellular network 294 (e.g., a 5G network) through an antenna (e.g., the antenna 248) and be converted to an IF signal by the third RFIC 226. The fourth RFIC 228 may convert an IF signal to a baseband signal so as to be processed by the second communication processor 214.

According to one embodiment, the first RFIC 222 and the second RFIC 224 may be implemented into at least part of a single package or a single chip. According to one embodiment, the first RFFE 232 and the second RFFE 234 may be implemented into at least part of a single package or a single chip. According to one embodiment, at least one of the first antenna module 242 or the second antenna module 244 may be omitted or may be combined with another antenna module to process RF signals of a corresponding plurality of bands.

According to one embodiment, the third RFIC 226 and the antenna 248 may be disposed at the same substrate to form a third antenna module 246. For example, the wireless communication module 192 or the processor 120 may be disposed at a first substrate (e.g., main PCB). In this case, the third RFIC 226 is disposed in a partial area (e.g., lower surface) of the first substrate and a separate second substrate (e.g., sub PCB), and the antenna 248 is disposed in another partial area (e.g., upper surface) thereof; thus, the third antenna module 246 may be formed. By disposing the third RFIC 226 and the antenna 248 in the same substrate, a length of a transmission line therebetween can be reduced. This may reduce, for example, a loss (e.g., attenuation) of a signal of a high frequency band (e.g., about 6 GHz to about 60 GHz) to be used in 5G network communication by a transmission line. Therefore, the electronic device 101 may improve a quality or speed of communication with the second cellular network 294 (e.g., 5G network).

According to one embodiment, the antenna 248 may be formed in an antenna array including a plurality of antenna elements that may be used for beamforming. In this case, the third RFIC 226 may include a plurality of phase shifters 238 corresponding to a plurality of antenna elements, for example, as part of the third RFFE 236. Upon transmission, each of the plurality of phase shifters 238 may convert a phase of a 5G Above6 RF signal to be transmitted to the outside (e.g., a base station of a 5G network) of the electronic device 101 through a corresponding antenna element. Upon reception, each of the plurality of phase shifters 238 may convert a phase of the 5G Above6 RF signal received from the outside to the same phase or substantially the same phase through a corresponding antenna element. This enables transmission or reception through beamforming between the electronic device 101 and the outside.

The second cellular network 294 (e.g., 5G network) may operate (e.g., stand-alone (SA)) independently of the first cellular network 292 (e.g., legacy network) or may be operated (e.g., non-stand alone (NSA)) in connection with the first cellular network 292. For example, the 5G network may have only an access network (e.g., 5G radio access network (RAN) or a next generation (NG) RAN and have no core network (e.g., next generation core (NGC)). In this case, after accessing to the access network of the 5G network, the electronic device 101 may access to an external network (e.g., Internet) under the control of a core network (e.g., an evolved packed core (EPC)) of the legacy network. Protocol information (e.g., LTE protocol information) for communication with a legacy network or protocol information (e.g., new radio (NR) protocol information) for communication with a 5G network may be stored in the memory 130 to be accessed by other components (e.g., the processor 120, the first communication processor 212, or the second communication processor 214).

Figure 3A:
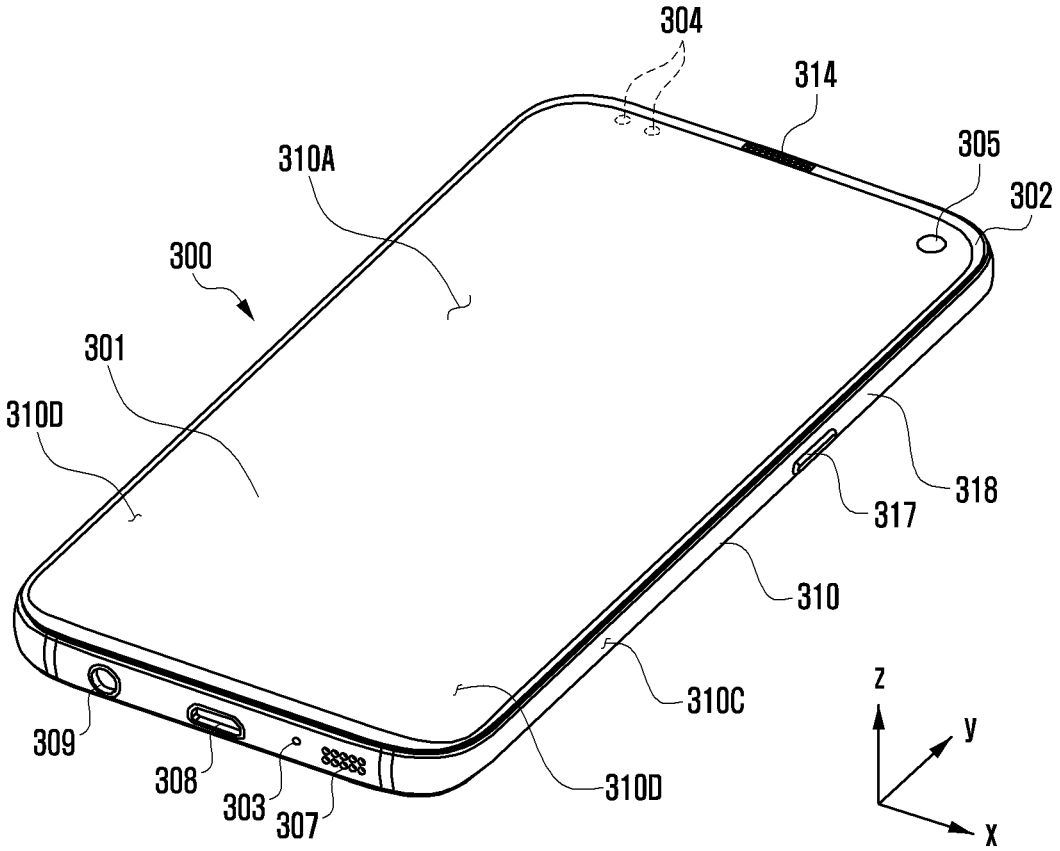
FIG. 3A is a perspective view of a mobile electronic device according to various embodiments.

FIG. 3A illustrates a perspective view showing a front surface of a mobile electronic device according to an embodiment of the disclosure.

Figure 3B:
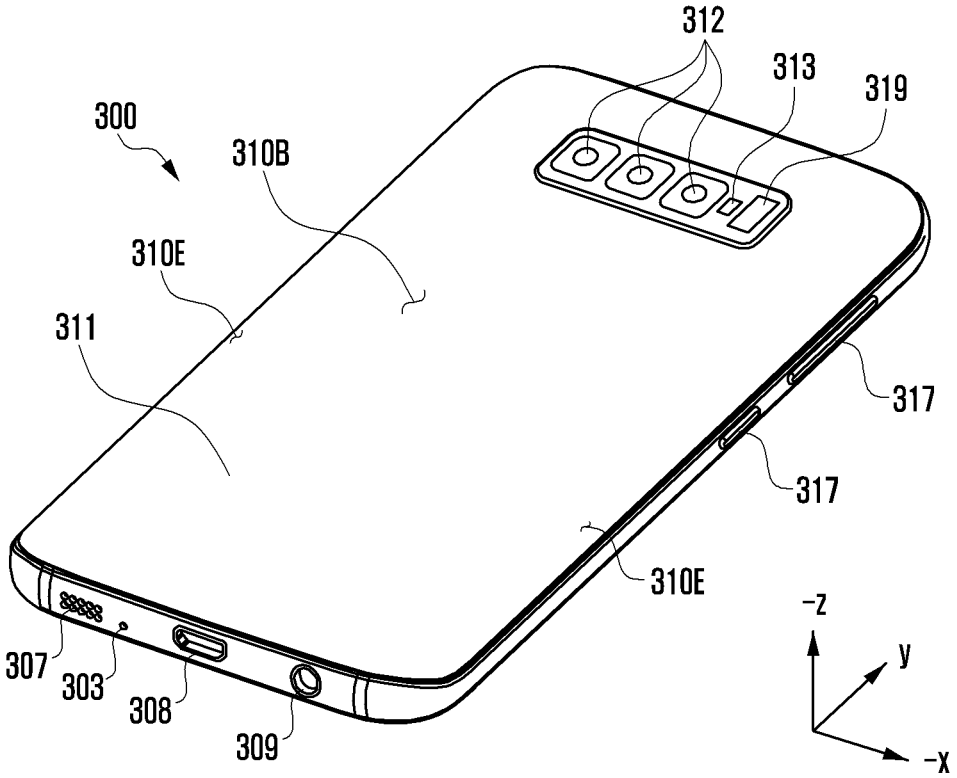
FIG. 3B is a rear perspective view of a mobile electronic device according to various embodiments.

FIG. 3B illustrates a perspective view showing a rear surface of the mobile electronic device shown in FIG. 3A according to an embodiment of the disclosure.

Referring to FIGS. 3A and 3B, a mobile electronic device 300 may include a housing 310 that includes a first surface (or front surface) 310A, a second surface (or rear surface) 310B, and a lateral surface 310C that surrounds a space between the first surface 310A and the second surface 310B. The housing 310 may refer to a structure that forms a part of the first surface 310A, the second surface 310B, and the lateral surface 310C. The first surface 310A may be formed of a front plate 302 (e.g., a glass plate or polymer plate coated with a variety of coating layers) at least a part of which is substantially transparent. The second surface 310B may be formed of a rear plate 311 which is substantially opaque. The rear plate 311 may be formed of, for example, coated or colored glass, ceramic, polymer, metal (e.g., aluminum, stainless steel (STS), or magnesium), or any combination thereof. The lateral surface 310C may be formed of a lateral bezel structure (or "lateral member") 318 which is combined with the front plate 302 and the rear plate 311 and includes a metal and/or polymer. The rear plate 311 and the lateral bezel structure 318 may be integrally formed and may be of the same material (e.g., a metallic material such as aluminum).

The front plate 302 may include two first regions 310D disposed at long edges thereof, respectively, and bent and extended seamlessly from the first surface 310A toward the rear plate 311. Similarly, the rear plate 311 may include two second regions 310E disposed at long edges thereof, respectively, and bent and extended seamlessly from the second surface 310B toward the front plate 302. The front plate 302 (or the rear plate 311) may include only one of the first regions 310D (or of the second regions 310E). The first regions 310D or the second regions 310E may be omitted in part. When viewed from a lateral side of the mobile electronic device 300, the lateral bezel structure 318 may have a first thickness (or width) on a lateral side where the first region 310D or the second region 310E is not included, and may have a second thickness, being less than the first thickness, on another lateral side where the first region 310D or the second region 310E is included.

The mobile electronic device 300 may include at least one of a display 301, audio modules 303, 307 and 314, sensor modules 304 and 319, camera modules 305, 312 and 313, a key input device 317, a light emitting device, and connector holes 308 and 309. The mobile electronic device 300 may omit at least one (e.g., the key input device 317 or the light emitting device) of the above components, or may further include other components.

The display 301 may be exposed through a substantial portion of the front plate 302, for example. At least a part of the display 301 may be exposed through the front plate 302 that forms the first surface 310A and the first region 310D of the lateral surface 310C. Outlines (i.e., edges and corners) of the display 301 may have substantially the same form as those of the front plate 302. The spacing between the outline of the display 301 and the outline of the front plate 302 may be substantially unchanged in order to enlarge the exposed area of the display 301.

A recess or opening may be formed in a portion of a display area of the display 301 to accommodate at least one of the audio module 314, the sensor module 304, the camera module 305, and the light emitting device. At least one of the audio module 314, the sensor module 304, the camera module 305, a fingerprint sensor (not shown), and the light emitting element may be disposed on the back of the display area of the display 301. The display 301 may be combined with, or adjacent to, a touch sensing circuit, a pressure sensor capable of measuring the touch strength (pressure), and/or a digitizer for detecting a stylus pen. At least a part of the sensor modules 304 and 319 and/or at least a part of the key input device 317 may be disposed in the first region 310D and/or the second region 310E. The audio modules 303, 307 and 314 may correspond to a microphone hole 303 and speaker holes 307 and 314, respectively. The microphone hole 303 may contain a microphone disposed therein for acquiring external sounds and, in a case, contain a plurality of microphones to sense a sound direction. The speaker holes 307 and 314 may be classified into an external speaker hole 307 and a call receiver hole 314. The microphone hole 303 and the speaker holes 307 and 314 may be implemented as a single hole, or a speaker (e.g., a piezo speaker) may be provided without the speaker holes 307 and 314.

The sensor modules 304 and 319 may generate electrical signals or data corresponding to an internal operating state of the mobile electronic device 300 or to an external environmental condition. The sensor modules 304 and 319 may include a first sensor module 304 (e.g., a proximity sensor) and/or a second sensor module (e.g., a fingerprint sensor) disposed on the first surface 310A of the housing 310, and/or a third sensor module 319 (e.g., a heart rate monitor (HRM) sensor) and/or a fourth sensor module (e.g., a fingerprint sensor) disposed on the second surface 310B of the housing 310. The fingerprint sensor may be disposed on the second surface 310B as well as the first surface 310A (e.g., the display 301) of the housing 310. The electronic device 300 may further include at least one of a gesture sensor, a gyro sensor, an air pressure sensor, a magnetic sensor, an acceleration sensor, a grip sensor, a color sensor, an infrared (IR) sensor, a biometric sensor, a temperature sensor, a humidity sensor, or an illuminance sensor.

The camera modules 305, 312 and 313 may include a first camera device 305 disposed on the first surface 310A of the electronic device 300, and a second camera module 312 and/or a flash 313 disposed on the second surface 310B. The camera module 305 or the camera module 312 may include one or more lenses, an image sensor, and/or an image signal processor. The flash 313 may include, for example, a light emitting diode or a xenon lamp. Two or more lenses (infrared cameras, wide angle and telephoto lenses) and image sensors may be disposed on one side of the electronic device 300.

The key input device 317 may be disposed on the lateral surface 310C of the housing 310. The mobile electronic device 300 may not include some or all of the key input device 317 described above, and the key input device 317 which is not included may be implemented in another form such as a soft key on the display 301. The key input device 317 may include the sensor module disposed on the second surface 310B of the housing 310.

The light emitting device may be disposed on the first surface 310A of the housing 310. For example, the light emitting device may provide status information of the electronic device 300 in an optical form. The light emitting device may provide a light source associated with the operation of the camera module 305. The light emitting device may include, for example, a light emitting diode (LED), an IR LED, or a xenon lamp.

The connector holes 308 and 309 may include a first connector hole 308 adapted for a connector (e.g., a universal serial bus (USB) connector) for transmitting and receiving power and/or data to and from an external electronic device, and/or a second connector hole 309 adapted for a connector (e.g., an earphone jack) for transmitting and receiving an audio signal to and from an external electronic device.

Some modules 305 of camera modules 305 and 312, some sensor modules 304 of sensor modules 304 and 319, or an indicator may be arranged to be exposed through a display 301. For example, the camera module 305, the sensor module 304, or the indicator may be arranged in the internal space of an electronic device 300 so as to be brought into contact with an external environment through an opening of the display 301, which is perforated up to a front plate 302. In another embodiment, some sensor modules 304 may be arranged to perform their functions without being visually exposed through the front plate 302 in the internal space of the electronic device. For example, in this case, an area of the display 301 facing the sensor module may not require a perforated opening.

Figure 3C:
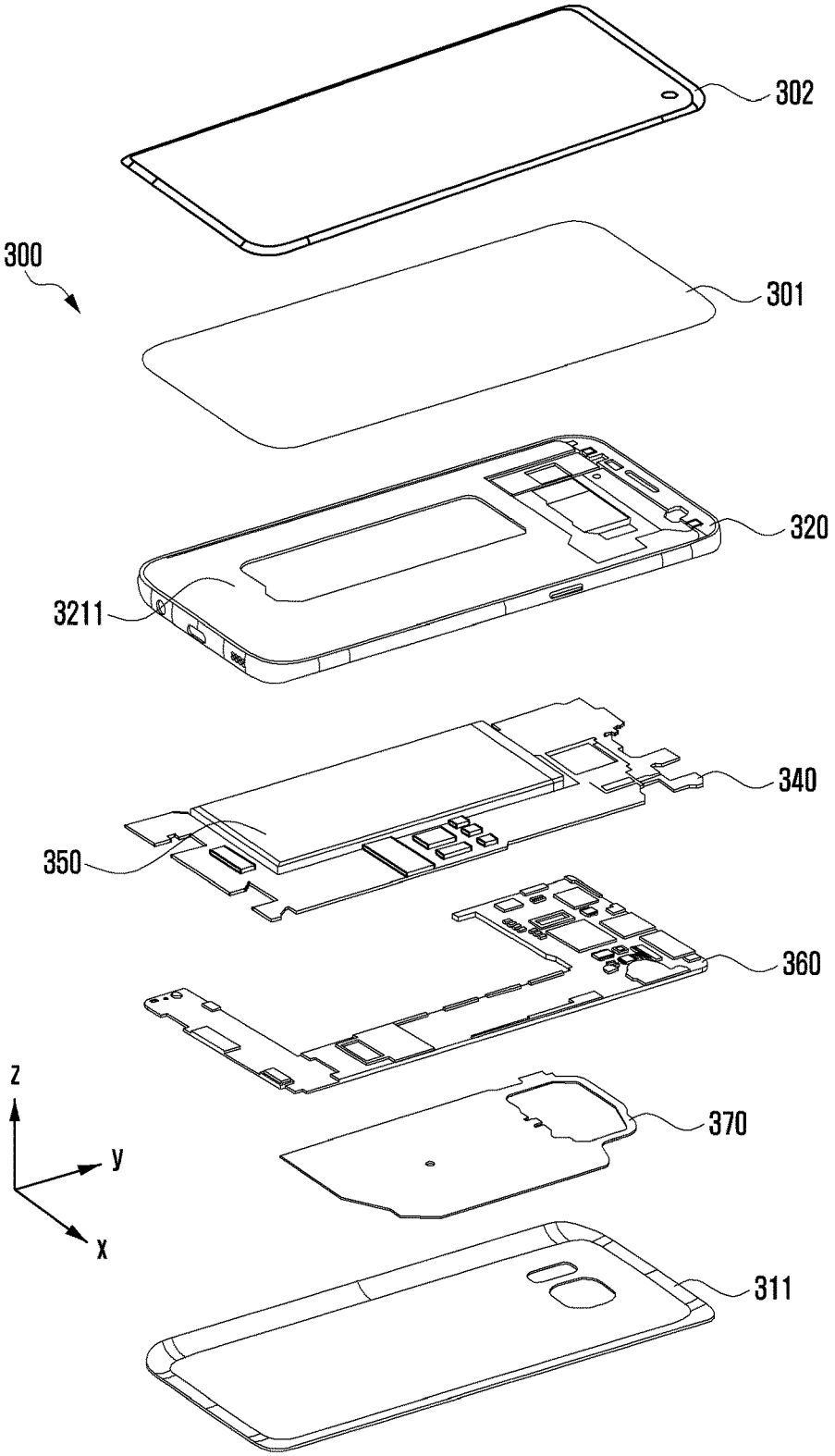
FIG. 3C is an exploded perspective view of a mobile electronic device according to various embodiments.

FIG. 3C illustrates an exploded perspective view showing a mobile electronic device shown in FIG. 3A according to an embodiment of the disclosure.

Referring to FIG. 3C, the mobile electronic device 300 may include a lateral bezel structure 320, a first support member 3211 (e.g., a bracket), the front plate 302, the display 301, an electromagnetic induction panel (not shown), a printed circuit board (PCB) 340, a battery 350, a second support member 360 (e.g., a rear case), an antenna 370, and a rear plate 311. The mobile electronic device 300 may omit at least one (e.g., the first support member 3211 or the second support member 360) of the above components or may further include another component. Some components of the electronic device 300 may be the same as or similar to those of the mobile electronic device 101 shown in FIG. 1 or FIG. 2, thus, descriptions thereof are omitted below.

The first support member 3211 is disposed inside the mobile electronic device 300 and may be connected to, or integrated with, the lateral bezel structure 320. The first support member 3211 may be formed of, for example, a metallic material and/or a non-metal (e.g., polymer) material. The first support member 3211 may be combined with the display 301 at one side thereof and also combined with the printed circuit board (PCB) 340 at the other side thereof. On the PCB 340, a processor, a memory, and/or an interface may be mounted. The processor may include, for example, one or more of a central processing unit (CPU), an application processor (AP), a graphics processing unit (GPU), an image signal processor (ISP), a sensor hub processor, or a communications processor (CP).

The memory may include, for example, one or more of a volatile memory and a non-volatile memory.

The interface may include, for example, a high definition multimedia interface (HDMI), a USB interface, a secure digital (SD) card interface, and/or an audio interface. The interface may electrically or physically connect the mobile electronic device 300 with an external electronic device and may include a USB connector, an SD card/multimedia card (MMC) connector, or an audio connector.

The battery 350 is a device for supplying power to at least one component of the mobile electronic device 300, and may include, for example, a non-rechargeable primary battery, a rechargeable secondary battery, or a fuel cell. At least a part of the battery 350 may be disposed on substantially the same plane as the PCB 340. The battery 350 may be integrally disposed within the mobile electronic device 300, and may be detachably disposed from the mobile electronic device 300.

The antenna 370 may be disposed between the rear plate 311 and the battery 350. The antenna 370 may include, for example, a near field communication (NFC) antenna, a wireless charging antenna, and/or a magnetic secure transmission (MST) antenna. The antenna 370 may perform short-range communication with an external device, or transmit and receive power required for charging wirelessly. An antenna structure may be formed by a part or combination of the lateral bezel structure 320 and/or the first support member 3211.

Figure 4A:
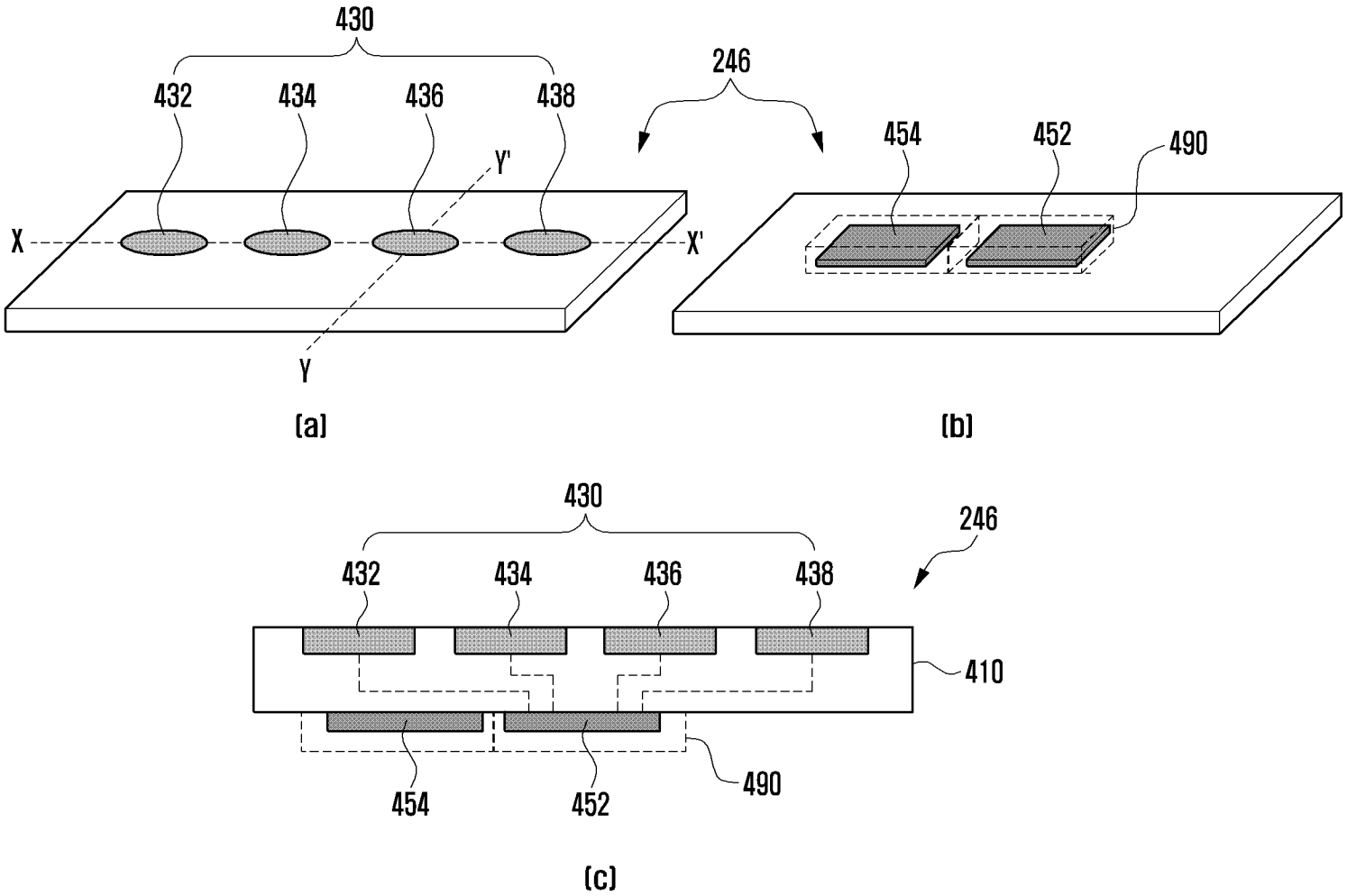
FIG. 4A illustrates an embodiment of a structure of a third antenna module described with reference to FIG. 2 according to various embodiments.

FIG. 4A is a diagram illustrating a structure of, for example, a third antenna module described with reference to FIG. 2 according to an embodiment of the disclosure. Referring to FIG. 4A, view (a) is a perspective view illustrating the third antenna module 246 viewed from one side, and FIG. 4A, view (b) is a perspective view illustrating the third antenna module 246 viewed from the other side. FIG. 4A, view (c) is a cross-sectional view illustrating the third antenna module 246 taken along line X-X' of FIG. 4A.

With reference to FIG. 4A, in one embodiment, the third antenna module 246 may include a printed circuit board 410, an antenna array 430, an RFIC 452, and a PMIC 454. Alternatively, the third antenna module 246 may further include a shield member 490. In other embodiments, at least one of the above-described components may be omitted or at least two of the components may be integrally formed.

The printed circuit board 410 may include a plurality of conductive layers and a plurality of non-conductive layers stacked alternately with the conductive layers. The printed circuit board 410 may provide electrical connections between the printed circuit board 410 and/or various electronic components disposed outside using wirings and conductive vias formed in the conductive layer.

The antenna array 430 (e.g., 248 of FIG. 2) may include a plurality of antenna elements 432, 434, 436, and/or 438 disposed to form a directional beam. As illustrated, the antenna elements 432, 434, 436, and/or 438 may be formed at a first surface of the printed circuit board 410. According to another embodiment, the antenna array 430 may be formed inside the printed circuit board 410. According to the embodiment, the antenna array 430 may include the same or a different shape or kind of a plurality of antenna arrays (e.g., dipole antenna array and/or patch antenna array).

The RFIC 452 (e.g., the third RFIC 226 of FIG. 2) may be disposed at another area (e.g., a second surface opposite to the first surface) of the printed circuit board 410 spaced apart from the antenna array. The RFIC 452 is configured to process signals of a selected frequency band transmitted/received through the antenna array 430. According to one embodiment, upon transmission, the RFIC 452 may convert a baseband signal obtained from a communication processor (not shown) to an RF signal of a designated band. Upon reception, the RFIC 452 may convert an RF signal received through the antenna array 430 to a baseband signal and transfer the baseband signal to the communication processor.

According to another embodiment, upon transmission, the RFIC 452 may up-convert an IF signal (e.g., about 9 GHz to about 11 GHz) obtained from an intermediate frequency integrate circuit (IFIC) (e.g., 228 of FIG. 2) to an RF signal of a selected band. Upon reception, the RFIC 452 may down-convert the RF signal obtained through the antenna array 430, convert the RF signal to an IF signal, and transfer the IF signal to the IFIC.

The PMIC 454 may be disposed in another partial area (e.g., the second surface) of the printed circuit board 410 spaced apart from the antenna array 430. The PMIC 454 may receive a voltage from a main PCB (not illustrated) to provide power necessary for various components (e.g., the RFIC 452) on the antenna module.

The shielding member 490 may be disposed at a portion (e.g., the second surface) of the printed circuit board 410 so as to electromagnetically shield at least one of the RFIC 452 or the PMIC 454. According to one embodiment, the shield member 490 may include a shield can.

Although not shown, in various embodiments, the third antenna module 246 may be electrically connected to another printed circuit board (e.g., main circuit board) through a module interface. The module interface may include a connecting member, for example, a coaxial cable connector, board to board connector, interposer, or flexible printed circuit board (FPCB). The RFIC 452 and/or the PMIC 454 of the antenna module may be electrically connected to the printed circuit board through the connection member.

Figure 4B:
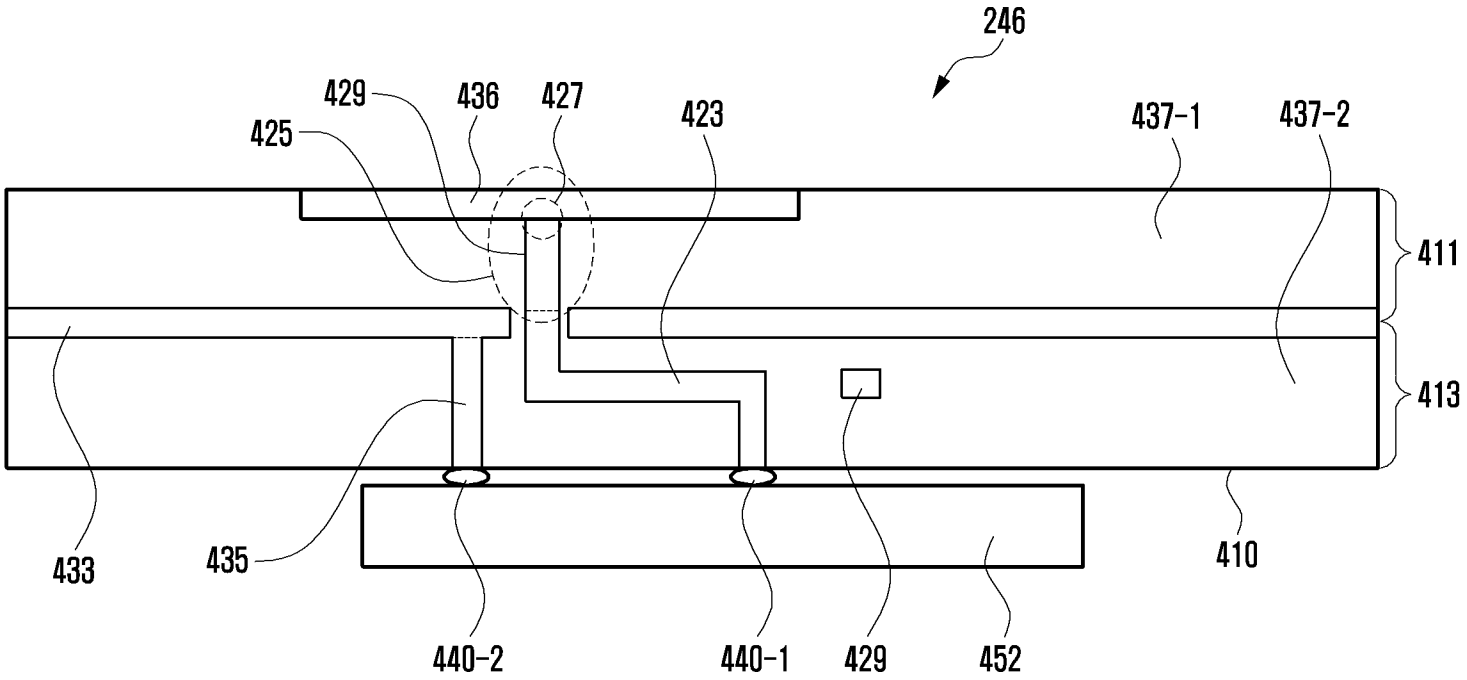
FIG. 4B is a cross-sectional view taken along line Y-Y' of a third antenna module shown in part (a) of FIG. 4A according to various embodiments.

FIG. 4B is a cross-sectional view illustrating the third antenna module 246 taken along line Y-Y' of FIG. 4A, view (a) according to an embodiment of the disclosure.

Referring to FIG. 4B, the printed circuit board 410 of the illustrated embodiment may include an antenna layer 411 and a network layer 413. The antenna layer 411 may include at least one dielectric layer 437-1, and an antenna element 436 and/or a power feeding portion 425 formed on or inside an outer surface of a dielectric layer. The power feeding portion 425 may include a power feeding point 427 and/or a power feeding line 429.

The network layer 413 may include at least one dielectric layer 437-2, at least one ground layer 433, at least one conductive via 435, a transmission line 423, and/or a power feeding line 429 formed on or inside an outer surface of the dielectric layer.

Further, in the illustrated embodiment, the RFIC 452 (e.g., the third RFIC 226 of FIG. 2) of FIG. 4A, view (c) may be electrically connected to the network layer 413 through, for example, first and second solder bumps 440-1 and 440-2. In other embodiments, various connection structures (e.g., solder or ball grid array (BGA)) instead of the solder bumps may be used. The RFIC 452 may be electrically connected to the antenna element 436 through the first solder bump 440-1, the transmission line 423, and the power feeding portion 425. The RFIC 452 may also be electrically connected to the ground layer 433 through the second solder bump 440-2 and the conductive via 435. Although not illustrated, the RFIC 452 may also be electrically connected to the above-described module interface through the power feeding line 429.

Figure 5:
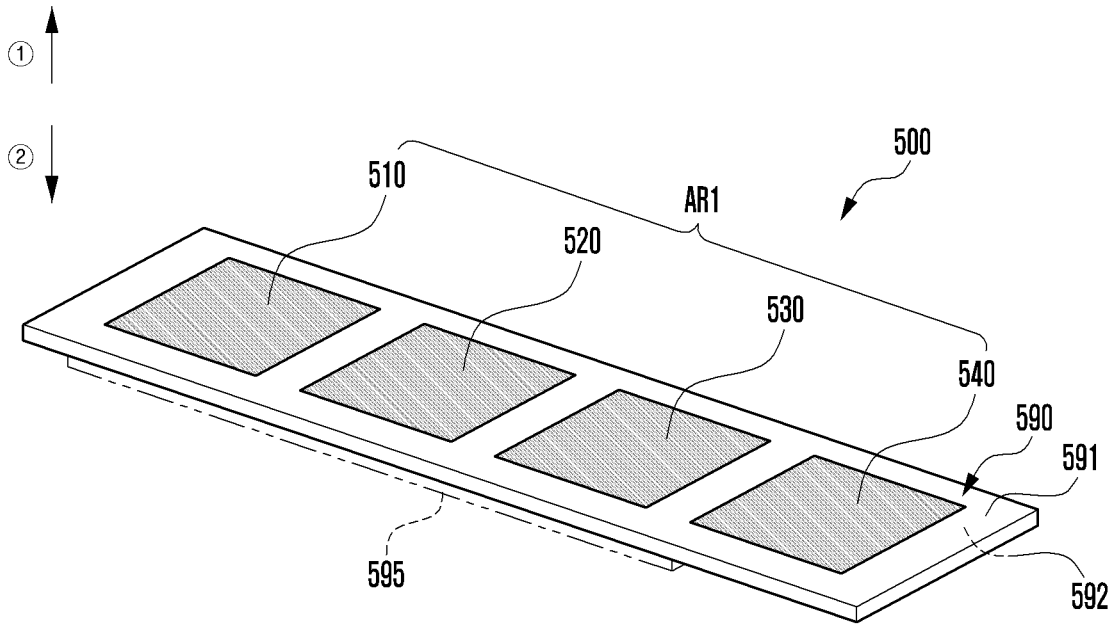
FIG. 5 is a perspective view of an antenna structure according to various embodiments.

FIG. 5 is a perspective view of an antenna structure 500 according to various embodiments.

The antenna structure 500 of FIG. 5 may be at least partially similar to the third antenna module 246 of FIG. 2, or may further include another embodiment of the antenna structure.

Referring to FIG. 5, the antenna structure 500 may include a printed circuit board 590 and an array antenna AR1 disposed on the printed circuit board 590. According to an embodiment, the array antenna AR1 may include a plurality of conductive patches 510, 520, 530, and 540 arranged at predetermined intervals on a substrate 590 (e.g., a flexible printed circuit board (FPCB) and/or a printed circuit board (PCB)). According to an embodiment, the plurality of conductive patches 510, 520, 530, and 540 may be formed on the substrate 590. According to an embodiment, the substrate 590 may include a first surface 591 facing a first direction (① direction) and a second surface 592 facing in the opposite direction (② direction) to the first surface 591. According to an embodiment, a wireless communication circuit 595 may be disposed on the second surface 592 of the substrate 590. In another embodiment, the wireless communication circuit 595 may be electrically connected to the substrate 590 through a separate electrical connection member (e.g., a FPCB and/or FRC; and a flexible printed circuit board (FPCB) type RF cable) in an internal space of an electronic device, the internal space being spaced apart from the substrate 590. According to an embodiment, the plurality of conductive patches 510, 520, 530, and 540 may be electrically connected to the wireless communication circuit 595. According to an embodiment, the wireless communication circuit 595 may be configured to transmit and/or receive a radio frequency in a range of about 3 GHz to 100 GHz through the array antenna AR1.

According to various embodiments, the plurality of conductive patches 510, 520, 530, and 540 may include a first conductive patch 510, a second conductive patch 520, a third conductive patch 530, and a fourth conductive patch 540, which are arranged at predetermined intervals on the first surface 591 of the substrate 590 or in a region adjacent to the first surface 591 in the substrate. The conductive patches 510, 520, 530, and 540 may have substantially the same configuration. The antenna structure 500 according to an exemplary embodiment shows and describes the array antenna AR1 including four conductive patches 510, 520, 530, and 540, but is not limited thereto. For example, the antenna structure 500 may include one, two, or five or more conductive patches as the array antenna AR1. In another embodiment, the antenna structure may be replaced by a plurality of conductive patterns (e.g., dipole antenna radiators) arranged on the substrate 590, or may further include the plurality of conductive patterns. In this case, the conductive patterns may be arranged such that a beam pattern direction of the conductive patterns is formed in a direction (e.g., a vertical direction) different from a beam pattern direction of the conductive patches 510, 520, 530 and 540. Although not shown, the antenna structure 500 may further include a protective member (e.g., urethane resin), as a protective means disposed to surround the wireless communication circuit 595 on the second surface 592 of the substrate 590, and/or a conductive coating material (e.g., an EMI coating material), as an EMI shielding means applied to the outer surface of the protective member to shield noise.

Figure 6A:
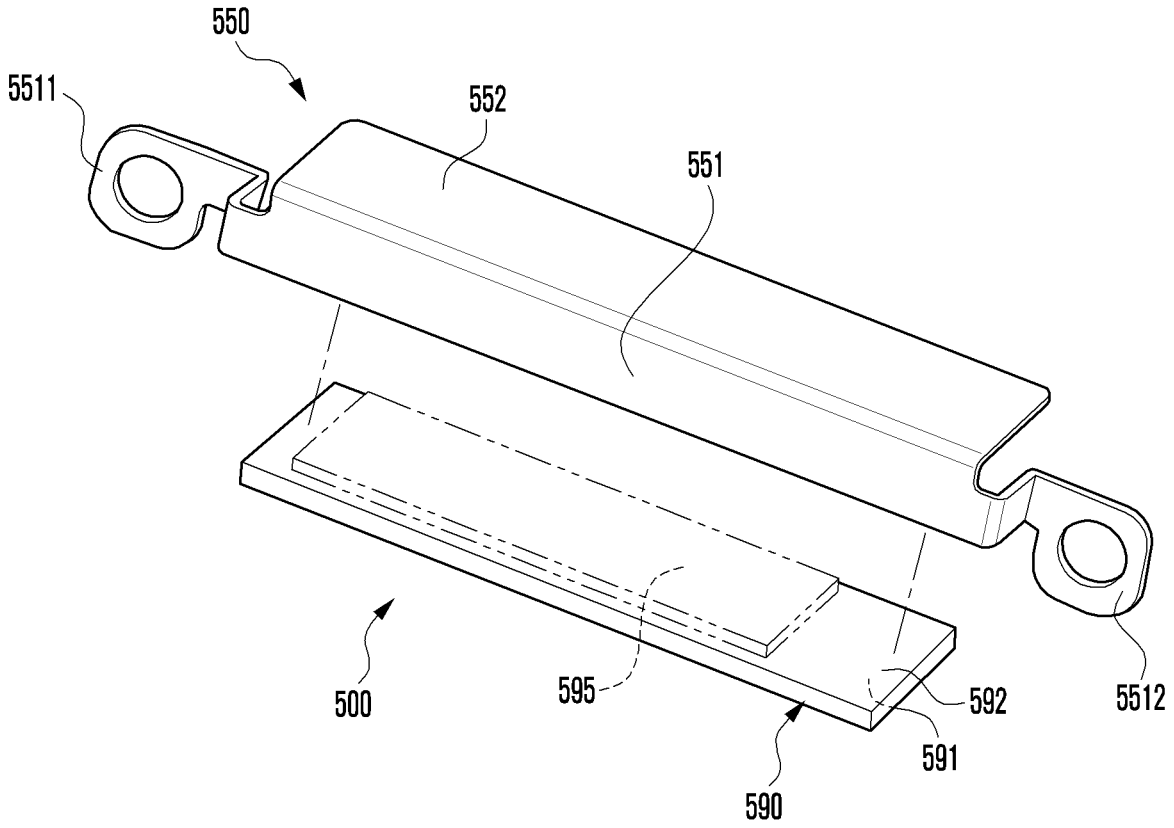
FIG. 6A is an exploded perspective view showing a state in which a support bracket is applied to an antenna structure according to various embodiments.
Figure 6B:
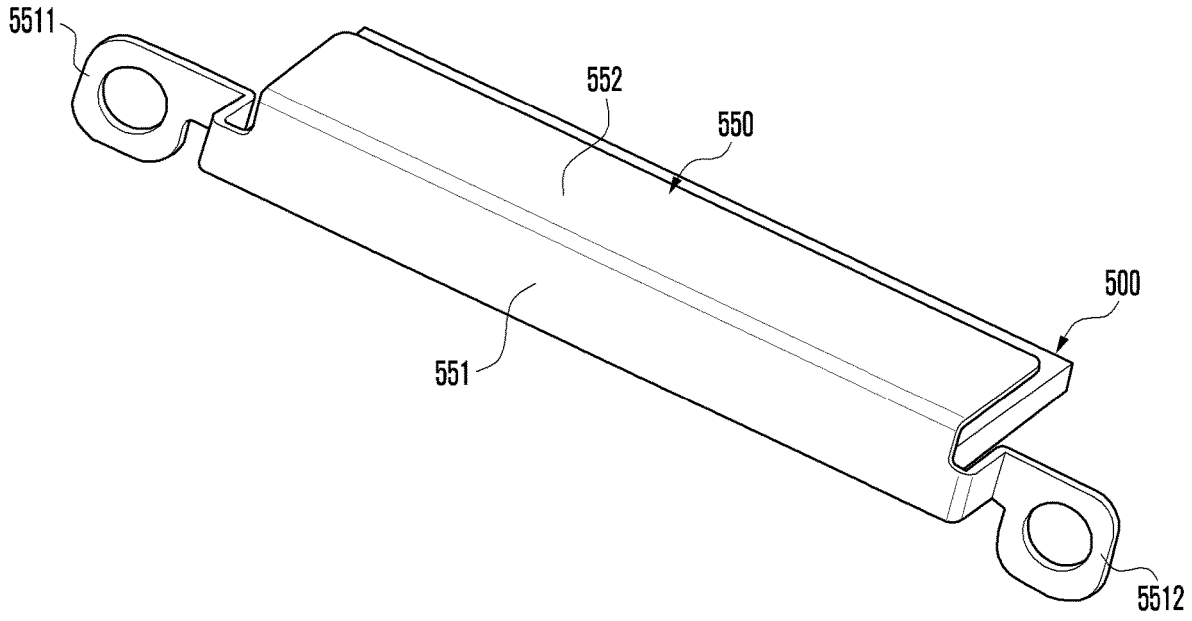
FIG. 6B is an assembled perspective view showing a state in which a support bracket is applied to an antenna structure according to various embodiments.

FIG. 6A is an exploded perspective view showing a state in which a support bracket 550 is applied to the antenna structure 500 according to various embodiments. FIG. 6B is an assembled perspective view showing a state in which the support bracket 550 is applied to the antenna structure 500 according to various embodiments.

Referring to FIGS. 6A and 6B, an electronic device (e.g., the electronic device 300 of FIG. 3A) may include a support bracket 550 made of a conductive material, as a support means which is at least partially fixed to the antenna structure 500. According to an embodiment, the support bracket 550 may be fixed to at least a portion of a first support member (e.g., a support member 3211 of FIG. 7), and/or a conductive member (e.g., a conductive member 321 of FIG. 7) of a housing (e.g., the housing 310 of FIG. 3A) in an internal space of the electronic device. According to an embodiment, the support bracket 550 may be physically in contact with the conductive member (e.g., the conductive member 321 of FIG. 7) of a side member (e.g., a side member 320 of FIG. 7), so as to help reinforce the rigidity of the antenna structure 500. According to an embodiment, the support bracket 550 may be formed of a metal member, such as SUS, Cu, or Al, and thus may be used as a heat dissipation means for effectively transferring, to the outside, high-temperature heat emitted from the antenna structure 500.

According to various embodiments, the support bracket 550 may include a first support part 551 which at least partially faces the substrate 590 (e.g., faces the side of the substrate 590), and a second support part 552 extending from the first support part 551 and bent to face another part of the substrate 590 (e.g., the second surface 592 of the substrate). According to an embodiment, the support bracket 550 may include one or more extension parts 5511 and 5512 extending from both ends of the first support part 551 to be fixed to at least a portion of the first support member (e.g., the support member 3211 of FIG. 7), and/or the conductive member (e.g., the conductive member 321 of FIG. 7) of the side member (e.g., the side member 320 of FIG. 7). According to an embodiment, the one or more extension parts 5511 and 5512 may be formed to extend in opposite directions of the support bracket 550, respectively. In another embodiment, the one or more extension parts 5511 and 5512 may extend from the second support part 552. Therefore, the antenna structure 500 may be supported by the first support part 551 and the second support part 552 of the support bracket 550, and fixed to at least a portion of the first support member (e.g., the support member 3211 of FIG. 7), and/or the conductive member (e.g., the conductive member 321 of FIG. 7) of the side member (e.g., the side member 320 of FIG. 7), through the one or more extension parts 5511 and 5512, by a fastening member such as a screw, as a fastening means.

Figure 7:
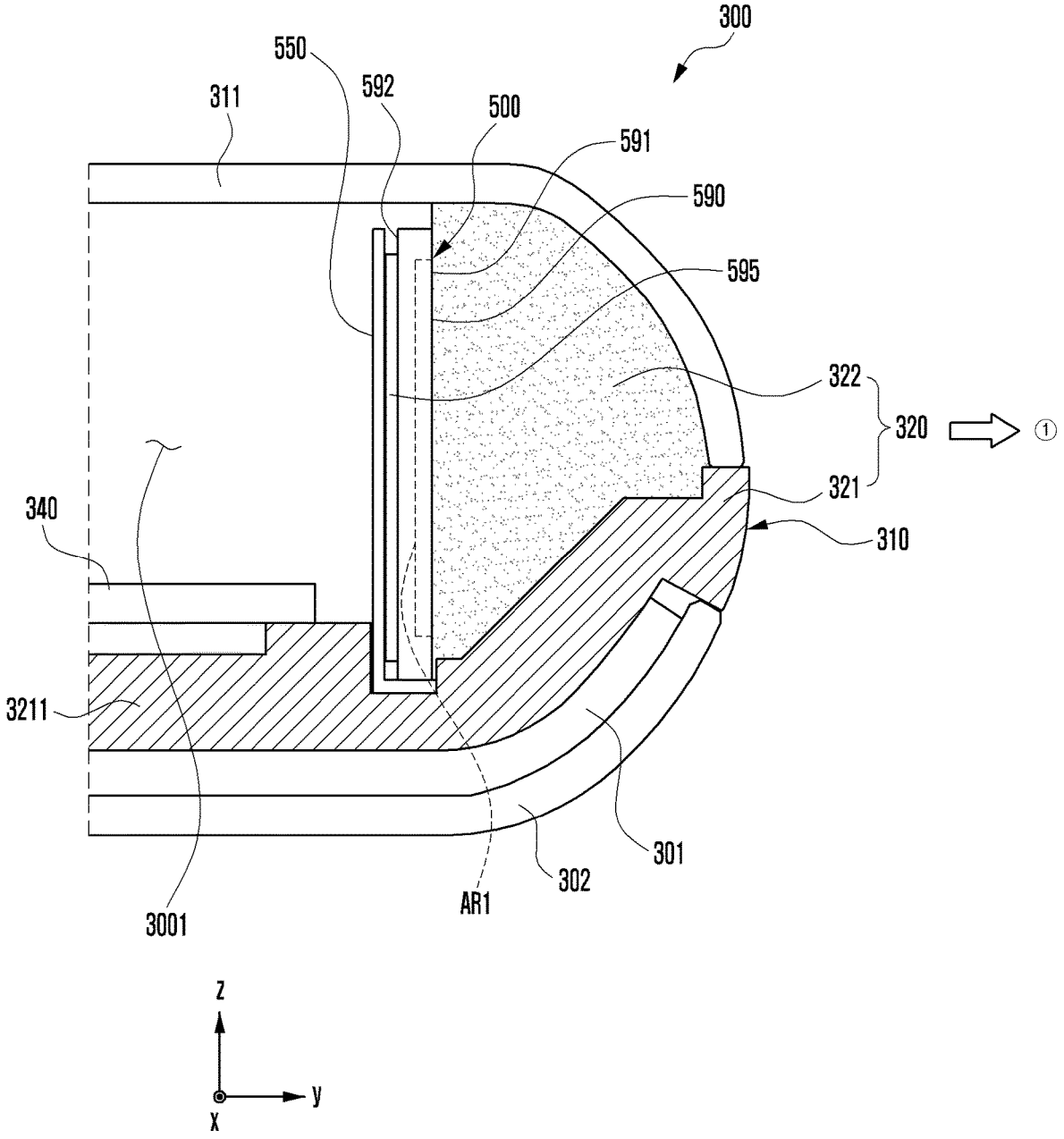
FIG. 7 is a partial cross-sectional view of an electronic device, taken along line A-A' of FIG. 3B, according to various embodiments.

FIG. 7 is a partial cross-sectional view of an electronic device 300, taken along line A-A' of FIG. 3B, according to various embodiments.

Referring to FIG. 7, the electronic device 300 may include a housing 310 (e.g., a housing structure) including a front cover 302 (e.g., a first cover, a first plate, a front plate, or a transparent cover) facing a first direction (−z-axis direction), a rear cover 311 (e.g., a second cover, a second plate, or a rear plate) facing the opposite direction (z-axis direction) to the front cover 302, and a side member 320 surrounding a space 3001 between the front cover 302 and the rear cover 311. According to an embodiment, the side member 320 may include a conductive member 321 (e.g., a metal member) which is at least partially disposed, and a non-conductive member 322 (e.g., a polymer) (e.g., a first non-conductive member) coupled to the conductive member 321. In another embodiment, the non-conductive member 322 may be replaced by the space or another dielectric material. In an embodiment, the non-conductive member 322 may be insert-injected into the conductive member 321. In another embodiment, the non-conductive member 322 may be structurally coupled to the conductive member 321. According to an embodiment, the side member 320 may include a support member 3211 (e.g., the first support member 3211 of FIG. 3C) (e.g., a second non-conductive member) as a support means extending from the side member 320 up to at least a portion of the internal space 3001. According to an embodiment, the support member 3211 may extend from the side member 320 to the internal space 3001 or may be formed by a structural coupling with the side member 320. According to an embodiment, the support member 3211 may extend from the conductive member 321. According to an embodiment, the support member 3211 may support at least a portion of the antenna structure 500 disposed in the internal space 3001. According to an embodiment, the support member 3211 may be disposed to support at least a portion of a display 301 which is a display means. According to an embodiment, the display 301 may be disposed to be visible from the outside through at least a portion of the front cover 302. According to an embodiment, the display 301 may include a flexible display.

According to various embodiments, the antenna structure 500 may be disposed in a direction perpendicular to the front cover 302 in the internal space 3001 of the electronic device 300 through the support bracket 550. According to an embodiment, the antenna structure 500 may be mounted such that an array antenna AR1 including conductive patches (e.g., the conductive patches 510, 520, 530, and 540 of FIG. 5A) faces the side member 320. For example, the antenna structure 500 may be disposed such that the first surface 591 of the substrate 590 faces the side member 320, so that the array antenna AR1 may form a beam pattern in a direction (e.g., ① direction) that the side member 320 of the electronic device 300 faces. According to an embodiment, the array antenna AR1 may form a beam pattern in the direction (e.g., ① direction) that the side member 320 faces, through the non-conductive member 322 of the side member 320. According to an embodiment, the electronic device 300 may include a device substrate 340 (e.g., the printed circuit board 340 of FIG. 3C) (e.g., a main substrate) disposed in the internal space 3001. According to an embodiment, although not shown, the antenna structure 500 may be electrically connected to the device substrate 340 through an electrical connector (e.g., an FPCB connector) as an electrical connection means.

Figure 8:
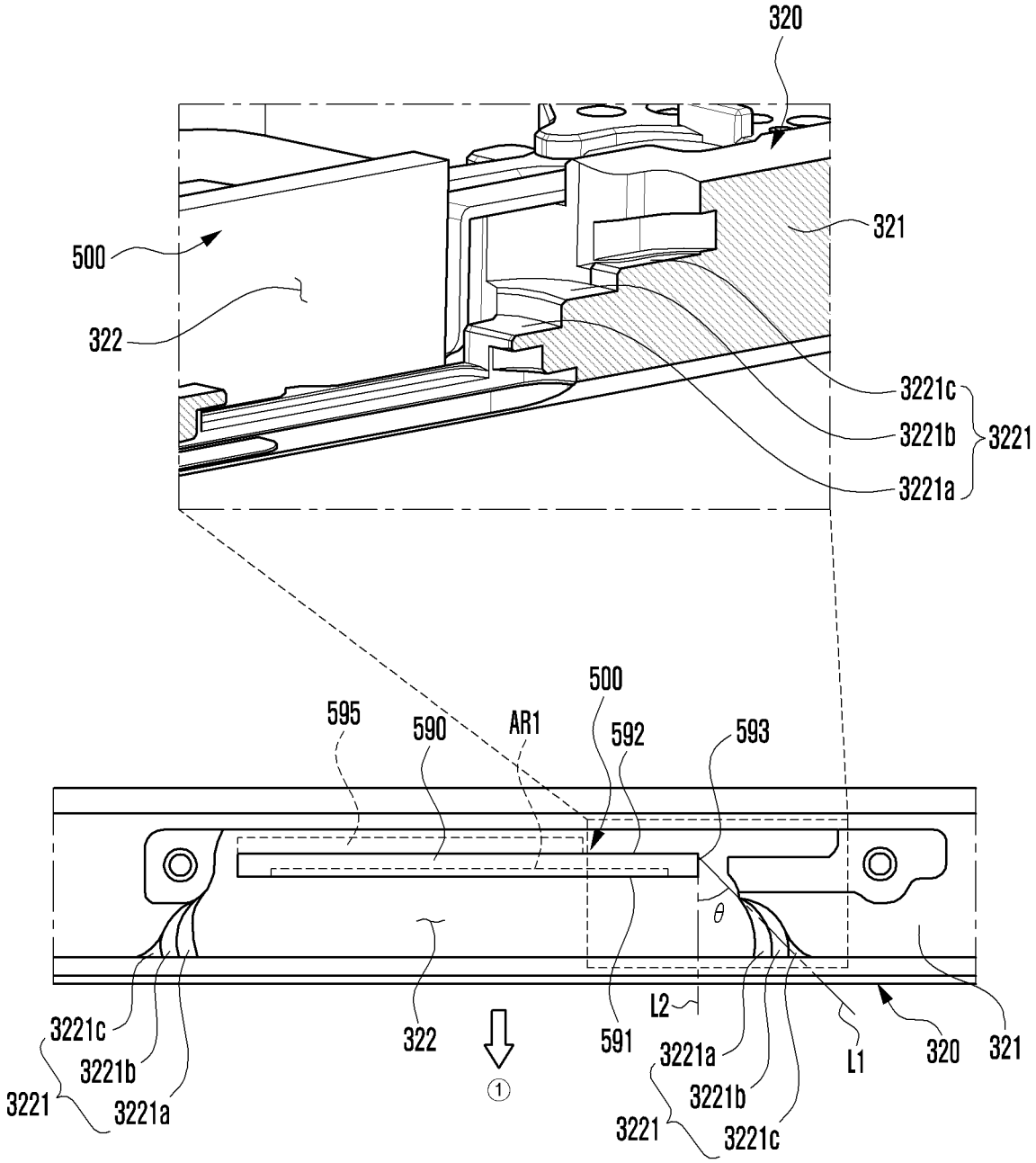
FIG. 8 is a sectional view, taken along line B-B' of FIG. 3B, showing a partial configuration of an electronic device according to various embodiments.

FIG. 8 is a sectional view, taken along line B-B' of FIG. 3B, showing a partial configuration of an electronic device according to various embodiments.

In FIG. 8 illustrating a rear cover (e.g., the rear cover 311 of FIG. 7) viewed from above, only the conductive member 321 is observed while the non-conductive member 322 is substantially hidden, although the non-conductive member is given a reference numeral for comparison between areas of the non-conductive member and the conductive member 321. The non-conductive member 322 may be a non-conductive member made of a polymer, and may be coupled with the conductive member 321.

Referring to FIG. 8, the side member 320 may include the non-conductive member 322 (e.g., a polymer) disposed in a region where a beam pattern formed from the antenna structure 500 is radiated. According to an embodiment, the non-conductive member 322 may be insert-injected into the surrounding conductive member 321. According to an embodiment, a boundary region between the non-conductive member 322 and the conductive member 321 may be disposed near the antenna structure 500. According to an embodiment, after the conductive member 321 and the non-conductive member 322 are coupled to each other, the boundary region may have a coupling structure in which the conductive member and the non-conductive member are not separated from each other by external impact. According to an embodiment, when the side member 320 is viewed from the outside, the boundary region may be disposed at least at a position not overlapping the antenna structure 500. For example, the conductive member 321 may include a concave part 3221 concavely formed in a direction away from the substrate 590 in the boundary region with the non-conductive member 322, and including one or more stepped parts 3221*a*, 3221*b*, and 3221*c*. According to an embodiment, the non-conductive member 322 may be filled in the concave part 3221 through insert injection, and thus formed as a part of the side member 320 of the electronic device 300. In another embodiment, the substrate 590 may further have at least one other electrical element mounted thereon in addition to the array antenna AR1, and in this case, the length of the substrate 590 may become longer. For example, when at least one electrical element is further mounted on the substrate 590, the concave part 3221 formed by the one or more stepped parts 3221*a*, 3221*b*, and 3221*c* in the boundary region between the conductive member 321 and the non-conductive member 322 does not overlap the array antenna AR1, and may gradually get higher or lower as the concave part is further leftward or rightward from the array antenna AR1. In this case, when the side member is viewed from the outside, the concave part 3221 does not overlap the array antenna AR1, but may at least partially overlap the substrate 590. According to various embodiments, when the side member 320 is viewed from the outside, the concave part 3221 may include a plurality of stepped parts 3221*a*, 3221*b*, and 3221*c* which are formed to gradually get higher or lower as the stepped parts are further from the substrate 590 in left-right directions of the antenna structure 500. According to an embodiment, the plurality of stepped parts 3221*a*, 3221*b*, and 3221*c* may be formed to become higher along a direction toward the rear cover (e.g., the rear cover 311 of FIG. 7). For example, the plurality of stepped parts 3221*a*, 3221*b*, and 3221*c* may include a first stepped part 3221*a* disposed closest to the substrate 590, a second stepped part 3221*b* extending higher from the first stepped part 3221*a*, and a third stepped part 3221*c* extending higher from the second stepped part 3221*b*. According to an embodiment, the concave part 3221 may be formed such that an angle θ formed by a first virtual line L1 connecting the first stepped part 3221*a*, the second stepped part 3221*b*, and the third stepped part 3221*c*, and a second virtual line L2 formed perpendicularly in an outward direction of the side member 320 from both ends (e.g., a shorter side 593) of the substrate 590 has a range of about 30° to 60°. In another embodiment, four or more stepped parts may be formed. According to an embodiment, when the side member 320 is viewed from the outside, the antenna structure 500 may smoothly form a beam pattern through the concave part 3221 including the plurality of stepped parts 3221*a*, 3221*b*, and 3221*c* extending in different heights from each other in a left-right direction of the substrate 590. In addition, since the side member 320 has an extended contact area with the non-conductive member 322 through the plurality of stepped parts 3221*a*, 3221*b*, and 3221*c*, at the time of insert injection, the side member can induce an enhanced binding force, and thus can be assisted in reinforcing the rigidity.

Figure 9:
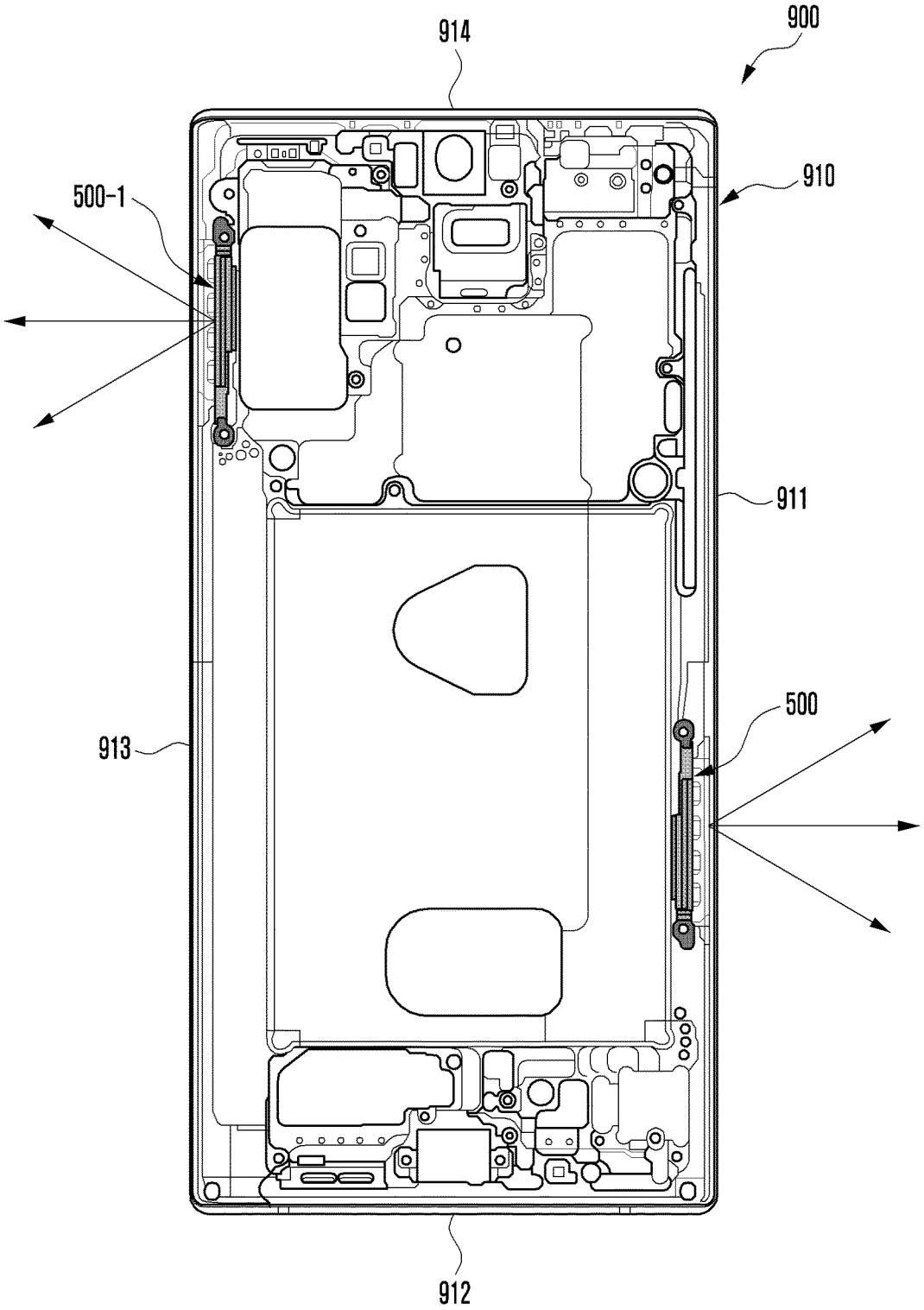
FIG. 9 illustrates an arrangement relationship of an antenna structure in an electronic device according to various embodiments.

FIG. 9 illustrates an arrangement relationship of an antenna structure 500 in an electronic device according to various embodiments.

An electronic device 900 of FIG. 9 may be at least partially similar to the electronic device 101 of FIG. 1 or the electronic device 300 of FIG. 3A, or may further include other embodiments of the electronic device.

Referring to FIG. 9, the electronic device 900 (e.g., the electronic device 300 of FIG. 7) may include a side member 910 (e.g., the side member 320 of FIG. 7). According to an embodiment, the side member 910 may include a first side 911 having a first length, a second side 912 extending in a vertical direction from the first side 911 and having a second length shorter than the first length, a third side 913 extending parallel to the first side 911 from the second side 912 and having the first length, and a fourth side 914 extending from the third side 913, having the second length, and connected to the first side.

According to various embodiments, the electronic device 900 may include a pair of antenna structures 500 and 500-1 arranged in an internal space thereof. According to an embodiment, each of the pair of antenna structures 500 and 500-1 may have substantially the same configuration as the antenna structure 500 of FIG. 5. According to an embodiment, as shown in FIG. 8, each of the pair of antenna structures 500 and 500-1 may have an arrangement structure which is substantially the same as an arrangement structure facing the non-conductive member 322 coupled to the concave part 3221 formed in the conductive member 321. According to an embodiment, when external impact is applied, the rigidity of the side member 910 may be weakened by a partial arrangement of the non-conductive member 322, or permanent deformation (e.g., distortion) of the side member may occur. Accordingly, the pair of antenna structures 500 and 500-1 may have an arrangement structure to minimize deformation of the side member 910. For example, one antenna structure 500 of the pair of antenna structures 500 and 500-1 may be disposed at a first point adjacent to the first side 911. According to an embodiment, the other antenna structure 500-1 may be disposed at a second point of the third side 913 which is diagonally symmetrical to the first point. In another embodiment, the pair of antenna structures 500 and 500-1 may be disposed at points diagonally symmetrical to each other on the second side 912 and the fourth side 914 opposite thereto, respectively. In another embodiment, when the electronic device 900 includes two or more antenna structures, the antenna structures may be disposed at points of the first side 911, the second side 912, the third side 913, and the fourth side 914, the points being diagonally symmetrical to each other, respectively.

Figure 10A:
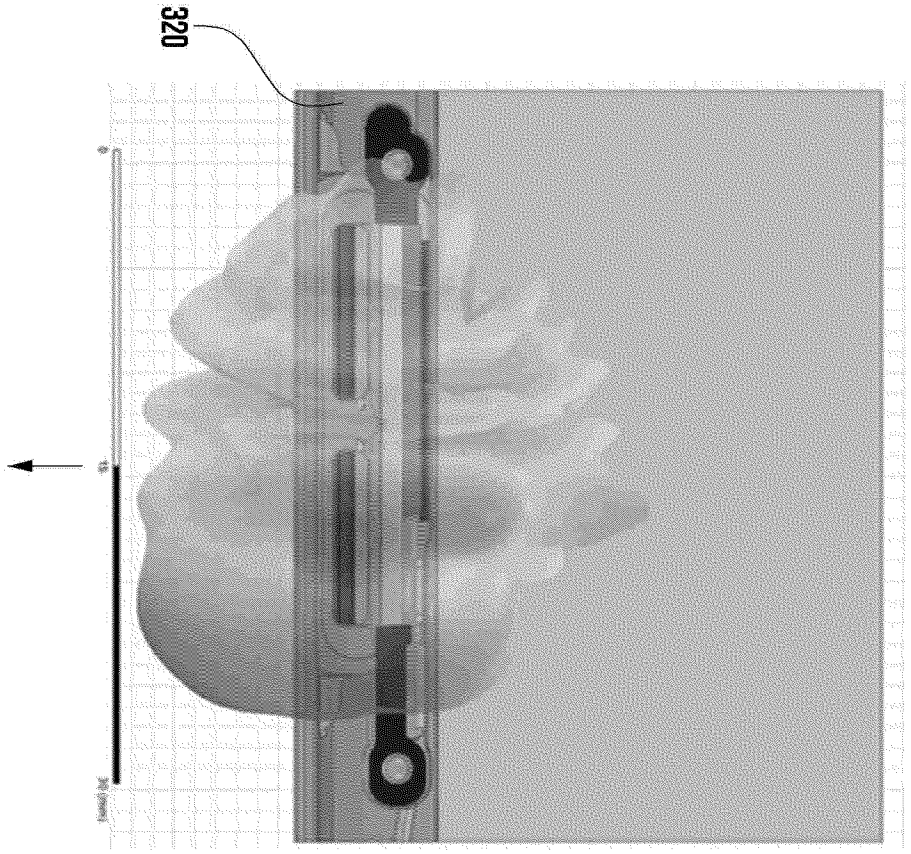
FIGS. 10A and 10B is a view showing a comparison between radiation areas of an antenna structure before and after formation of a concave part, according to various embodiments.
Figure 10B:
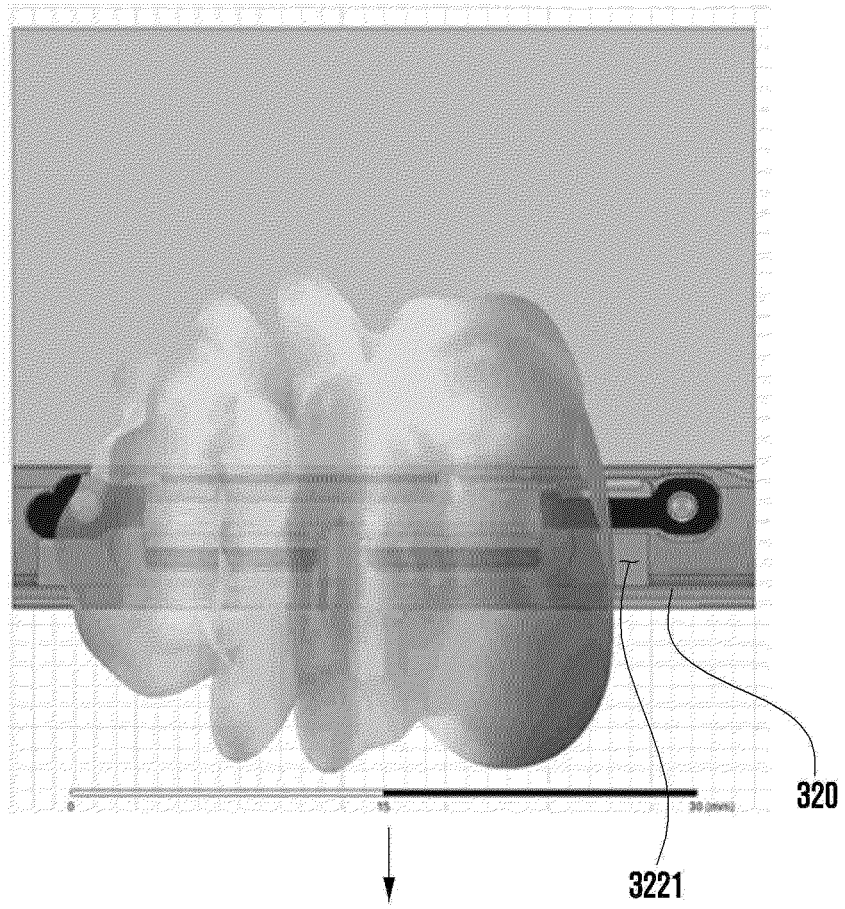

FIGS. 10A and 10B illustrate a comparison between radiation areas of the antenna structure 500 before and after formation of the concave part 3221, according to various embodiments.

Referring to FIGS. 10A and 10B, it can be seen that a radiation area formed from the antenna structure 500 extends outwards from the antenna structure 500 more than in the case of FIG. 10A in which the concave part 3221 does not exist, and the radiation area is further increased in the case of FIG. 10B including the concave part 3221 for receiving the non-conductive member 322, which may mean that the radiation performance of the antenna structure 500 is improved.

Figure 11:
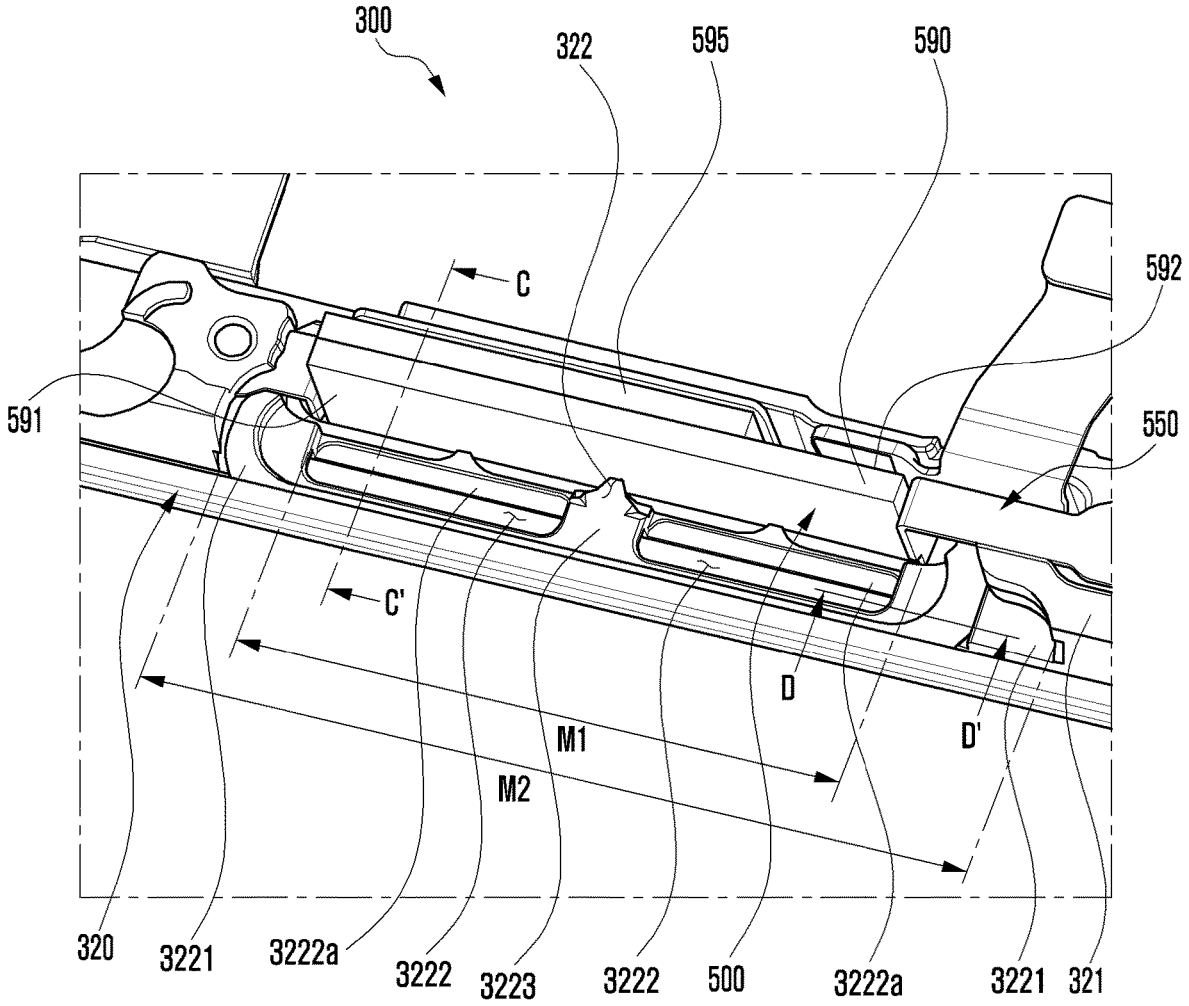
FIG. 11 is a partial perspective view of an electronic device showing a state in which an antenna structure is disposed, according to various embodiments.
Figure 12A:
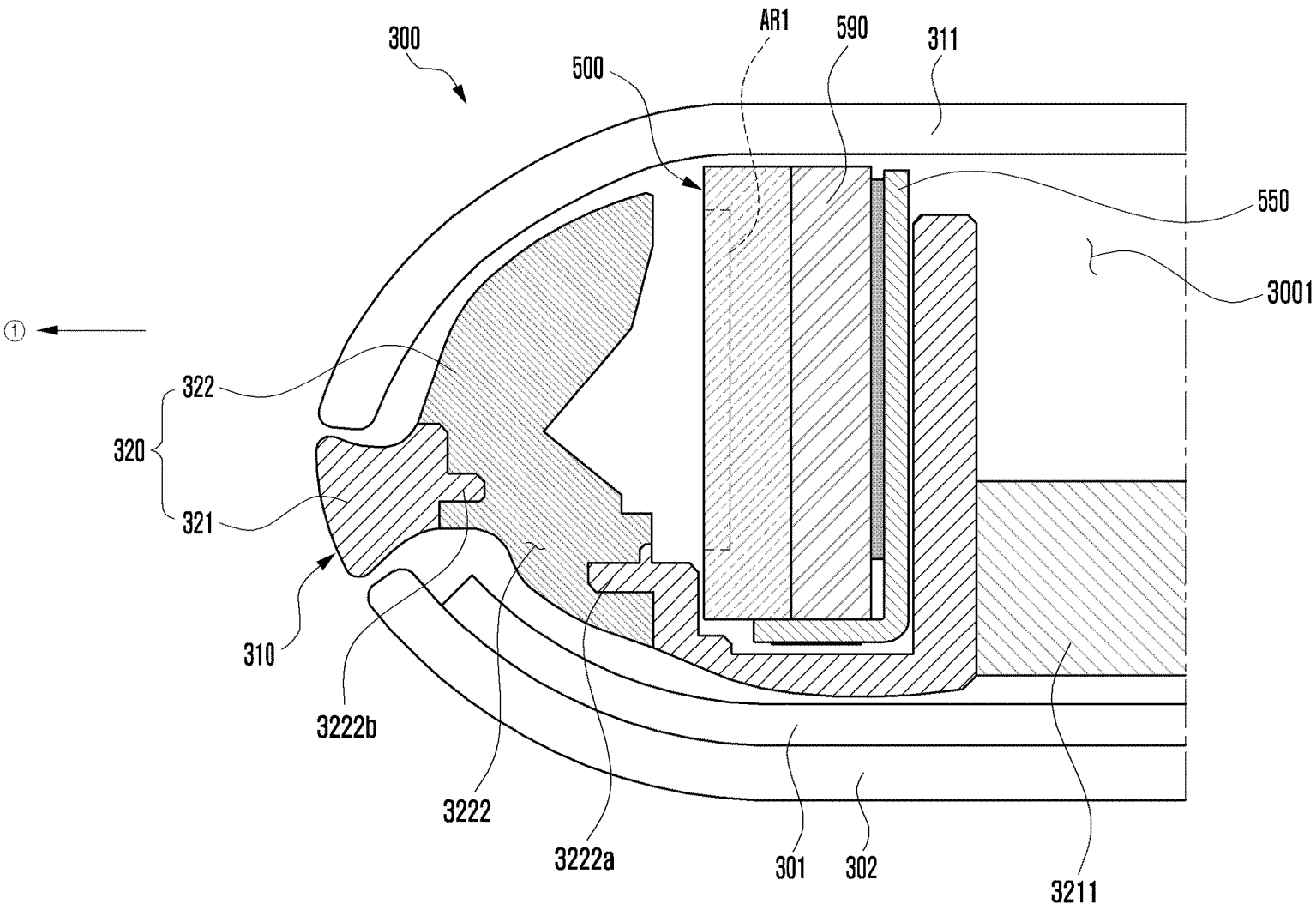
FIG. 12A is a partial cross-sectional view of an electronic device, taken along line C-C' of FIG. 11, according to various embodiments.

FIG. 11 is a partial perspective view of an electronic device showing a state in which the antenna structure 500 is disposed, according to various embodiments. FIG. 12A is a partial cross-sectional view of the electronic device 300, taken along line C-C' of FIG. 11, according to various embodiments.

In explaining FIGS. 11 and 12A, the same reference numerals are assigned to the same components of the electronic device 300 including the above-described antenna structure 500 and side member 320, and detailed description thereof may be omitted.

In FIG. 11 illustrating a rear cover (e.g., the rear cover 311 of FIG. 7) viewed from above, only the conductive member 321 is observed while the non-conductive member 322 is substantially hidden, although the non-conductive member is given a reference numeral for comparison between areas of the non-conductive member and the conductive member 321.

Referring to FIGS. 11 and 12A, the side member 320 may include the conductive member 321, and a first non-conductive member 322 (e.g., an injection-molded material) (e.g., the non-conductive member 322 of FIG. 8) coupled to the conductive member 321 and disposed in a region facing the substrate 590 of the antenna structure 500.

According to various embodiments, the side member 320 may include at least one through-hole 3222 formed in at least a portion of a region facing the front cover 302 and disposed such that the first non-conductive member 322 extends. According to an embodiment, the first non-conductive member 322 may be disposed to be exposed to the outer surface of the side member 320 through the at least one through-hole 3222. According to an embodiment, the at least one through-hole 3222 may be disposed to at least partially face a space between the display 301 and the conductive member 321. Accordingly, a beam pattern generated from the antenna structure 500 may be radiated through the at least one through-hole 3222. According to an embodiment, the number of the at least one through-hole 3222 may be determined through at least one conductive connection part 3223 as a connection means connected to cross one through-hole 3222. For example, as shown, the at least one through-hole 3222 may include two through-holes 3222 when one conductive connection part 3223 is formed. In another embodiment, the at least one through-hole 3222 may include three through-holes 3222 when two conductive connection parts 3223 are spaced apart from each other at a predetermined interval. In an embodiment, one through-hole 3222 may be formed without a conductive connection part 3223.

According to various embodiments, a total length M1 (e.g., a first injection region filling a through-hole) including a through-hole 3222 may be formed to be shorter than a total length M2 of the first non-conductive member 322 including the concave part 3221. In another embodiment, the total length M1 (e.g., the first injection region filling the through-hole) of the through-hole 3222 may be formed to be the same as or longer than the total length M2 of the first non-conductive member 322 including the concave part 3221 according to a beam shape and/or a radial direction of a beam pattern through the through-hole.

According to various embodiments, the at least one through-hole 3222 may include one or more flanges 3222*a* and 3222*b* as a support means at least partially extending from an edge of the through-hole 3222 toward a central direction of the through-hole 3222. According to an embodiment, the one or more flanges 3222*a* and 3222*b* may be formed to have a thickness equal to or smaller than a thickness of the conductive member 321. According to an embodiment, the one or more flanges 3222*a* and 3222*b* may extend from edges facing each other of the through-hole toward the center of the through-hole. The one or more flanges 3222*a* and 3222*b* may strengthen a coupling force of the first non-conductive member 322 which is insert-injected up to the through-hole 3222, and may help reinforce the rigidity of the side member 320.

According to various embodiments, the side member 320 may include a second non-conductive member 3211 (e.g., the first support member 3211 of FIG. 3C) extending from the conductive member 321 to the internal space 3001 of the electronic device 300. According to an embodiment, the second non-conductive member 3211 may be formed of a different material from the first non-conductive member 322. According to an embodiment, the first non-conductive member 322 may be formed of a dielectric material having a low dielectric constant that can help improve radiation performance of the antenna structure 500, and the second non-conductive member 3211 may be formed of a reinforced synthetic resin material for reinforcing the rigidity. In another embodiment, the second non-conductive member 3211 may be formed of the same material as that of the first non-conductive member 322. In this case, the second non-conductive member 3211 may be formed together when the first non-conductive member 322 is insert-injected into the conductive member 321.

Figure 12B:
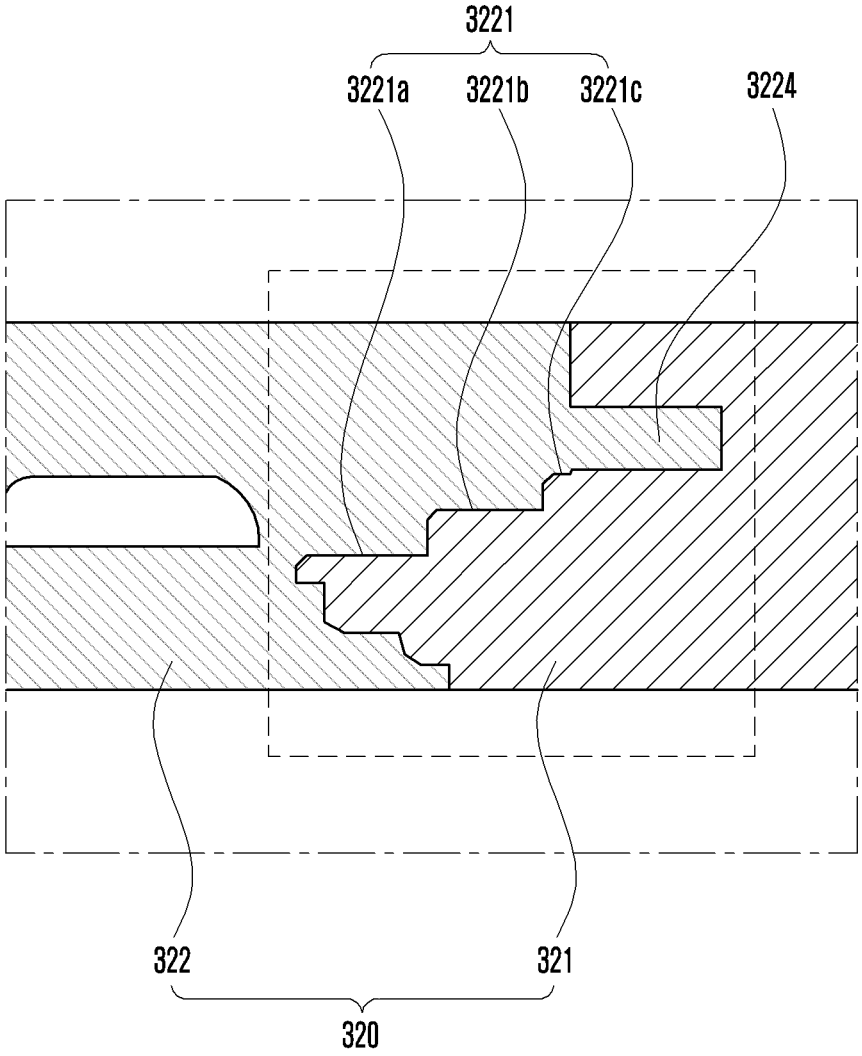
FIG. 12B is a partial cross-sectional view of a side member, taken along line D-D' of FIG. 11, according to various embodiments.

FIG. 12B is a partial cross-sectional view of the side member 320, taken along line D-D' of FIG. 11, according to various embodiments.

Referring to FIG. 12B, the side member 320 may include the first non-conductive member 322 which is insert-injected into the conductive member 321. According to an embodiment, the conductive member 321 may include the concave part 3221 including a plurality of stepped parts (e.g., the plurality of stepped parts 3221*a*, 3221*b*, and 3221*c* of FIG. 8) having different heights in a boundary region with the first non-conductive member 322. According to an embodiment, the conductive member 321 may have, as a recess structure recessed inward, at least one insertion groove 3224 formed around the concave part 3221. According to an embodiment, the at least one insertion groove 3224 may receive the first non-conductive member 322 to expand a contact surface, and thus help reinforce the rigidity of the side member 320.

Figure 12C:
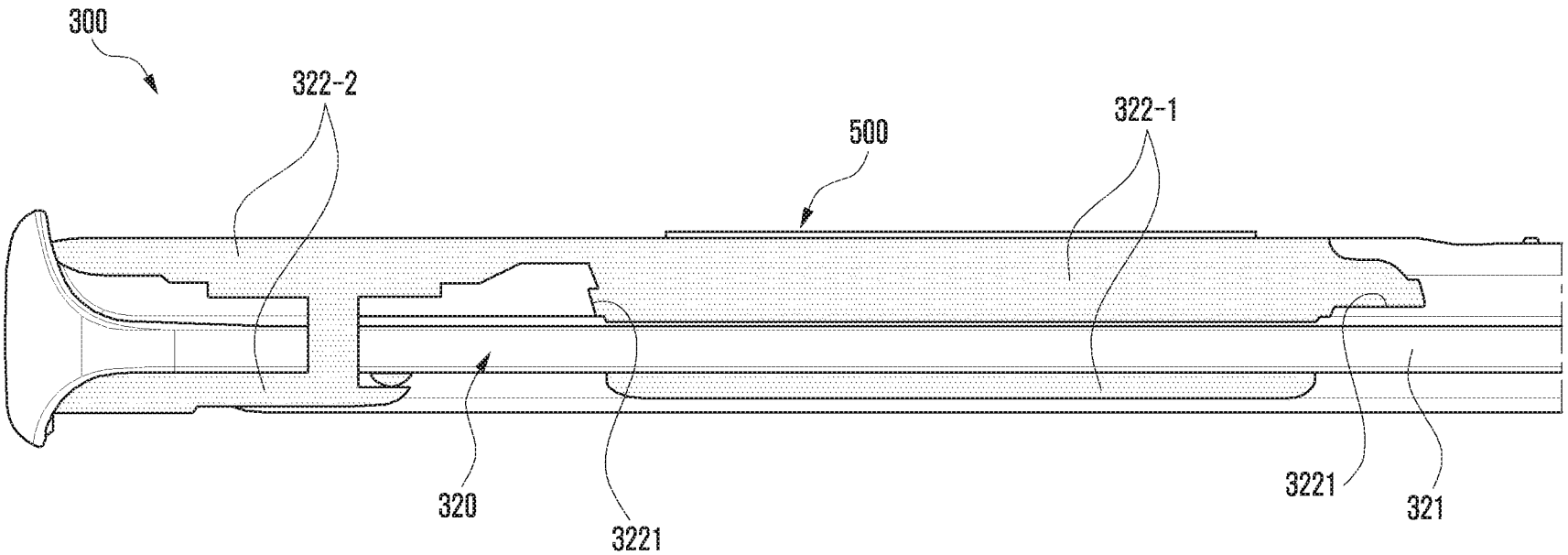
FIG. 12C illustrates a side member of an electronic device showing a state in which a non-conductive member is coupled to a conductive member, according to various embodiments.

FIG. 12C illustrates the side member 320 of the electronic device 300 showing a state in which a non-conductive member 322-1 or 322-2 is coupled to the conductive member 321, according to various embodiments.

Referring to FIG. 12C, the electronic device 300 may include the conductive member 321 and one or more non-conductive members 322-1 and 322-2 insert-injected into or coupled to the conductive member 321. According to an embodiment, the one or more non-conductive members 322-1 and 322-2 may include a first non-conductive member 322-1 disposed around the antenna structure 500, and a second non-conductive member 322-2 disposed in the other region. According to an embodiment, the first non-conductive member 322-1 and the second non-conductive member 322-2 may be formed of different materials or the same material. According to an embodiment, the one or more non-conductive members 322-1 and 322-2 may be arranged to have different injection amounts for each region according to a radial direction of the antenna structure 500. For example, as shown, when a beam pattern is formed in a direction in which a rear cover (e.g., the rear cover 311 of FIG. 7) or the side member 320 faces, the antenna structure 500 may be disposed such that the injection amount of the rear or side surface is greater than the injection amount of other regions.

Figure 13:
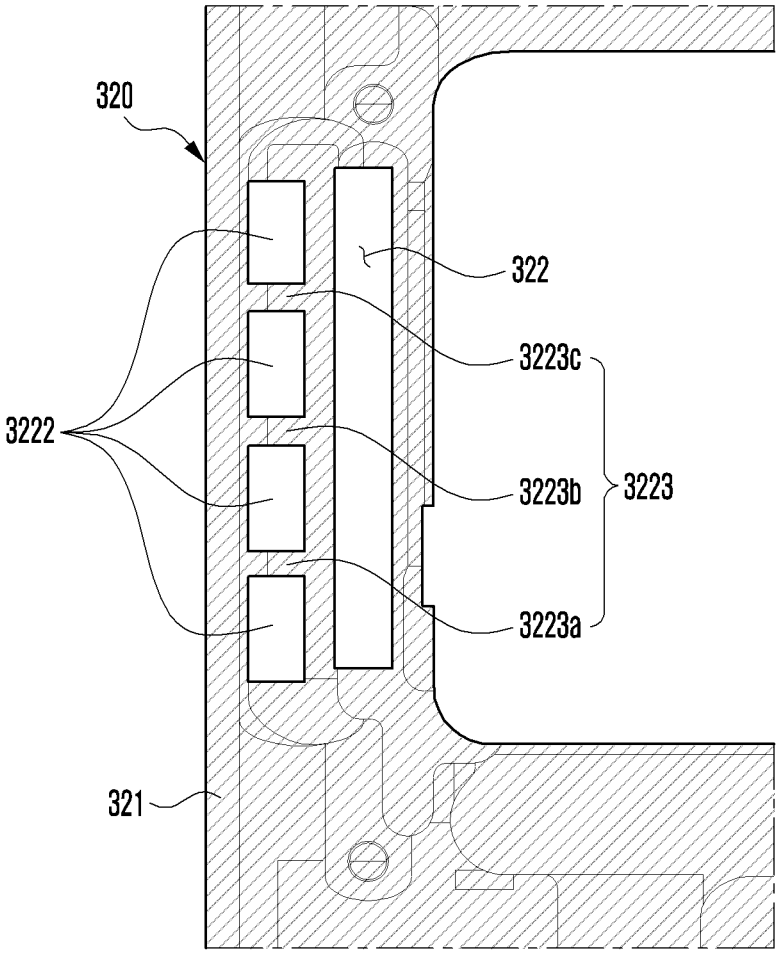
FIG. 13 illustrates a partial configuration of a side member having a plurality of through-holes formed therethrough, according to various embodiments.

FIG. 13 illustrates a partial configuration of a side member having a plurality of through-holes formed therethrough, according to various embodiments.

Referring to FIG. 13, the side member 320 may include at least one through-hole 3222. According to an embodiment, the number of the at least one through-hole 3222 may be determined through at least one conductive connection part 3223 crossing the through-hole 3222. For example, as shown, four through-holes 3222 may be formed through three conductive connection parts 3223*a*, 3223*b*, and 3223*c* which are spaced apart from each other by a predetermined interval.

Figure 14A:
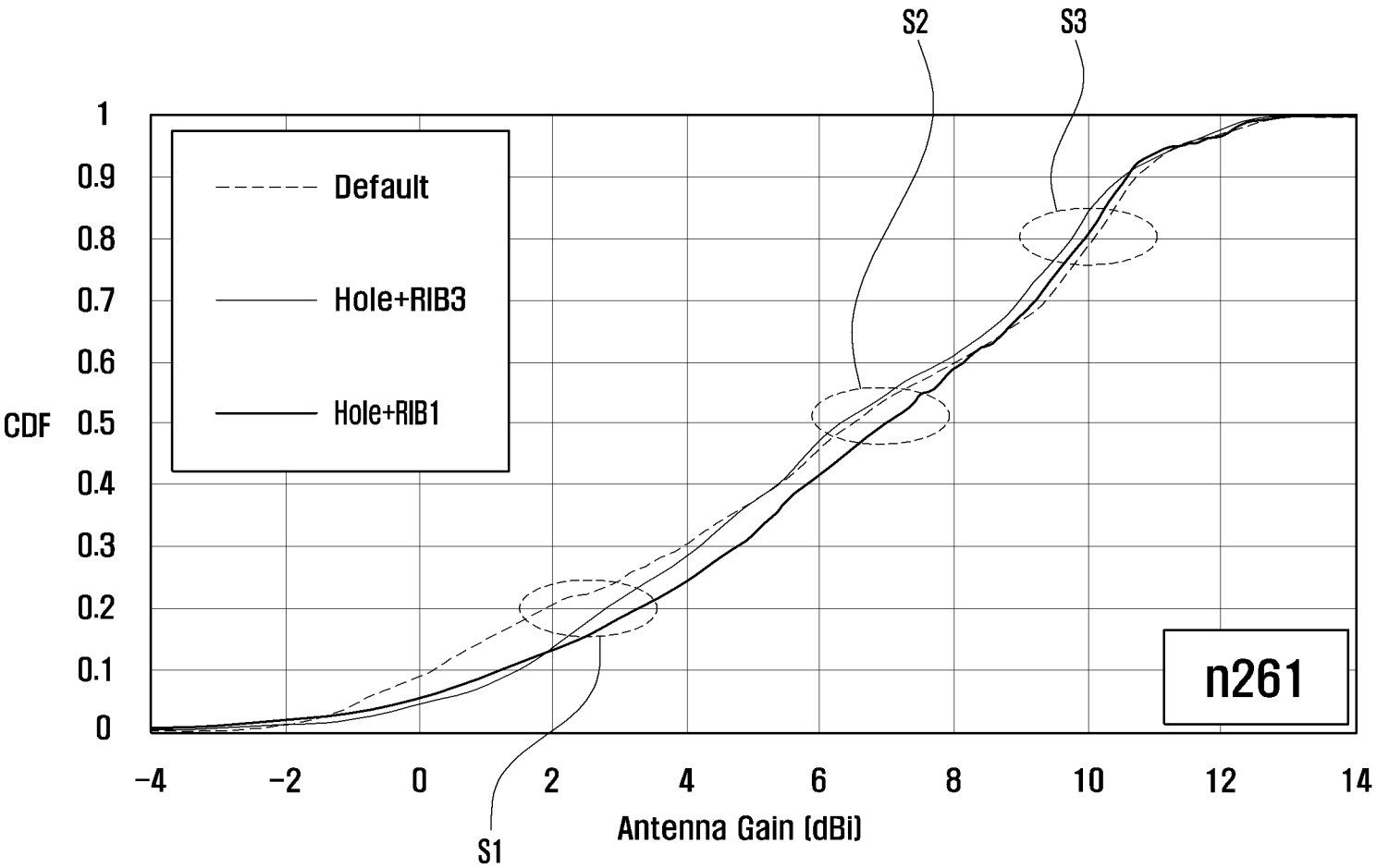
FIG. 14A is a graph showing a comparison of performance of an antenna structure according to the number of through-holes in a first frequency band and a second frequency band, according to various embodiments.
Figure 14B:
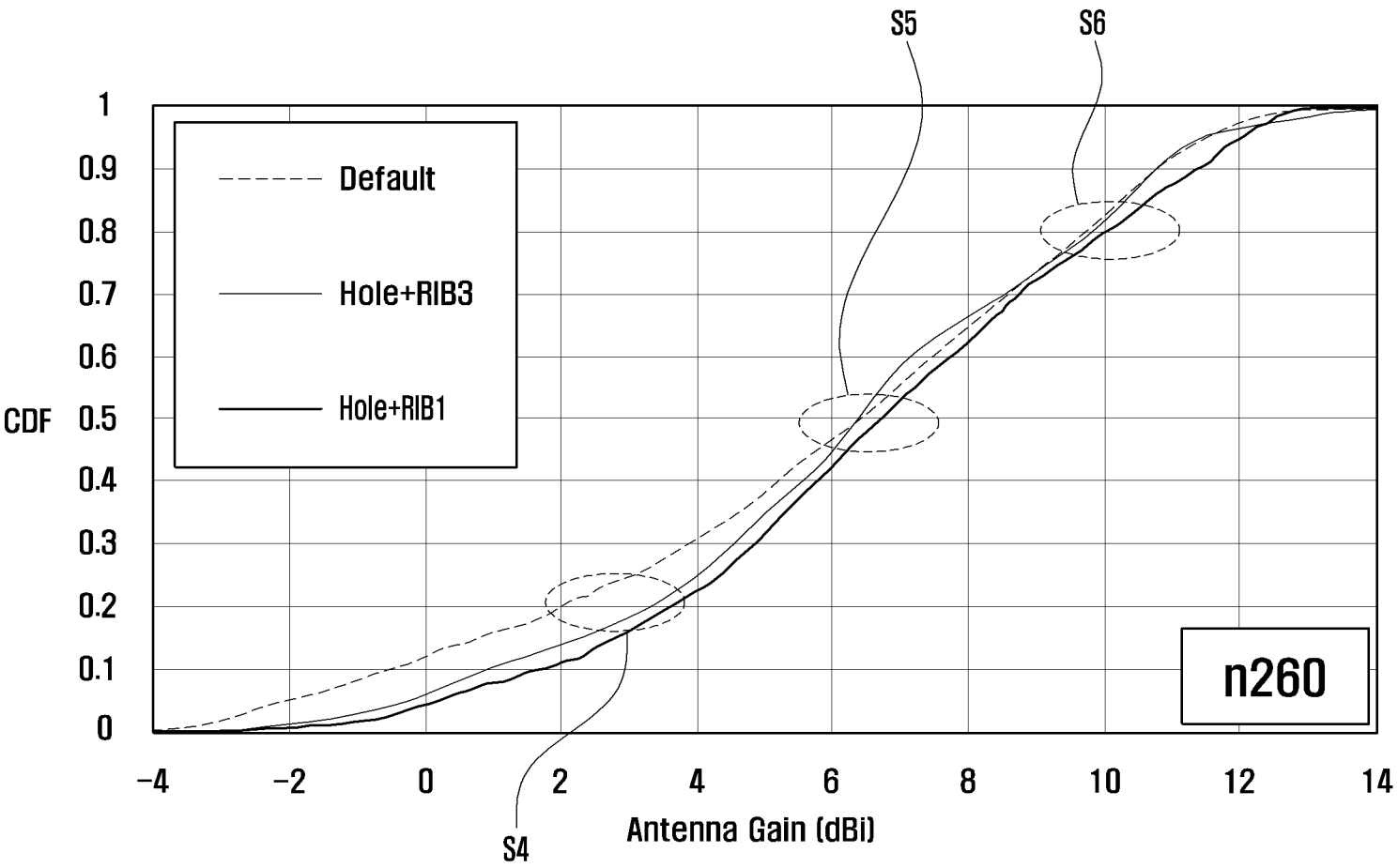
FIG. 14B is a graph showing a comparison of performance of an antenna structure according to the number of through-holes in a first frequency band and a second frequency band, according to various embodiments.

FIG. 14A is a graph showing a comparison of performance of an antenna structure according to the number of through-holes in a first frequency band and a second frequency band, according to various embodiments, and FIG. 14B is a graph showing a comparison of performance of an antenna structure according to the number of through-holes in a first frequency band and a second frequency band, according to various embodiments.

FIG. 14A is a graph showing a cumulative distribution function (CDF) characteristic of the antenna structure 500 according to the number of through-holes 3222 in an n261 band (about a 28 GHz band) which is a first frequency band, and FIG. 14B is a graph showing a CDF characteristic of the antenna structure 500 according to the number of through-holes 3222 in an n260 band (about a 39 GHz band), which is a second frequency band higher than the first frequency band.

Referring to FIGS. 14A and 14B and Table 1 below, it can be seen that, in a CDF 0.2 section (an S1 section and an S4 section), a CDF 0.5 section (an S2 section and an S5 section), and a CDF 0.8 section (an S3 section and an S6 section), in the case of having two through-holes 3222 formed by one conductive connection part 3223 (e.g., in the case of FIG. 11) (hole+RIB1), a gain is improved more than in the case of having no through-hole (default) or in the case of having four through-holes 3222 formed by three conductive connection parts 3223*a*, 3223*b*, and 3223*c* (hole+RIB3). This may mean that when a through-hole 3222 is present, the smaller the number of through-holes, the better the performance of the antenna structure.

TABLE 1

| | n261(28 GHz) | | | n260(39 GHz) | | |
|---|---|---|---|---|---|---|
| | Default | Hole + RIB1 | Hole + RIB3 | Default | Hole + RIB1 | Hole + RIB3 |
| CDF0.2 | 2 | 3.3 | 2.9 | 2 | 3.6 | 3.3 |
| CDF0.5 | 6.5 | 7 | 6.3 | 6.4 | 6.7 | 6.4 |
| CDF0.8 | 10.1 | 10 | 9.8 | 9.7 | 10.1 | 9.8 |
| Peak gain | 13.1 | 13 | 12.9 | 13.2 | 13.2 | 14.2 |

According to various embodiments, an electronic device (e.g., the electronic device 300 of FIG. 7) may include: a housing (e.g., the housing 310 of FIG. 7) including a side member (e.g., the side member 320 of FIG. 7) including a conductive member (e.g., the conductive member 321 of FIG. 7) and a non-conductive member (e.g., the non-conductive member 322 of FIG. 7) coupled with the conductive member; and at least one antenna structure (e.g., the antenna structure 500 of FIG. 7) disposed in an internal space of the housing and including a substrate (e.g., the substrate 590 of FIG. 7) and at least one antenna element (e.g., the array antenna AR1 of FIG. 7), the substrate being disposed to face the side member, and the at least one antenna element being disposed on the substrate and including a beam pattern formed through the non-conductive member in a direction in which the side member faces, wherein: when the side member is viewed from the outside, a boundary region between the conductive member and the non-conductive member is disposed in a region not overlapping the substrate; in the boundary region, the conductive member includes at least one concave part (e.g., the concave part 3221 of FIG. 8) formed to at least partially receive the non-conductive member; and the at least one concave part includes two or more stepped parts (e.g., the stepped parts 3221*a*, 3221*b*, and 3221*c* of FIG. 8) which gradually get higher or lower as the stepped parts are further leftward or rightward from the substrate, when the side member is viewed from the outside.

According to various embodiments, the housing may include a first cover (e.g., the front cover 302 of FIG. 7), a second cover (e.g., the rear cover 311 of FIG. 7) facing in a direction opposite to the first cover, and the side member surrounding the internal space (e.g., the internal space 3001 of FIG. 7) between the first cover and the second cover, and when the side member is viewed from the outside, the two or more stepped parts may be formed to gradually get higher as the stepped parts are further leftward or rightward from the substrate and become closer to the second cover.

According to various embodiments, the electronic device may include a wireless communication circuit (e.g., the wireless communication circuit 595 of FIG. 7) disposed in the internal space and configured to transmit and/or receive a wireless signal in a range of about 3 GHz to 100 GHz through the at least one antenna element.

According to various embodiments, the wireless communication circuit may be mounted on the substrate.

According to various embodiments, the at least one concave part may be formed such that an angle formed by a first virtual line (e.g., the first virtual line L1 of FIG. 8) formed by the two or more stepped parts, and a second virtual line (e.g., the second virtual line L2 of FIG. 8) formed perpendicularly in an outward direction of the side member from an end of the substrate has a range of about 30° to 60°.

According to various embodiments, the side member may further include at least one through-hole (e.g., the through-hole 3222 of FIG. 11) through which the non-conductive member is disposed to extend.

According to various embodiments, the non-conductive member may be exposed to the outer surface of the side member through the at least one through-hole.

According to various embodiments, a total length of the at least one through-hole (e.g., the total length M1 of the through-hole in FIG. 11) may be formed to be shorter than, equal to, or longer than a total length of the non-conductive member (e.g., the total length M2 of the non-conductive member in FIG. 11).

According to various embodiments, at least a portion of the beam pattern may be formed through the at least one through-hole.

According to various embodiments, the number of the at least one through-hole may be determined through at least one conductive connection part (e.g., the conductive connection part 3223 of FIG. 11) connected to cross the through-hole.

According to various embodiments, the at least one conductive connection part may integrally extend from the conductive member.

According to various embodiments, the electronic device may include at least one flange (e.g., the flange 3222*a* of FIG. 11) which at least partially extends from an edge of the at least one through-hole in a central direction of the through-hole.

According to various embodiments, the at least one flange may be formed to have a thickness equal to or smaller than a thickness of the conductive member.

According to various embodiments, the at least one through-hole may be disposed at a position facing the substrate.

According to various embodiments, the at least one through-hole may be formed to have a length equal to or longer than that of the substrate.

According to various embodiments, the side member may include another non-conductive member (e.g., the second non-conductive member 3211 of FIG. 12A) which at least partially extends into the internal space.

According to various embodiments, the another non-conductive member may be formed of the same material as or a different material from the non-conductive member.

According to various embodiments, the non-conductive member may be formed of a polymer having a lower dielectric constant than that of the another non-conductive member.

According to various embodiments, the side member (e.g., the side member 910 of FIG. 9) may include a first side (e.g., the first side 911 of FIG. 9) having a first length, a second side (e.g., the second side 912 of FIG. 9) extending in a vertical direction from the first side and having a second length shorter than the first length, a third side (e.g., the third side 913 of FIG. 9) extending parallel to the first side from the second side and having the first length, and a fourth side (e.g., the fourth side 914 of FIG. 9) extending from the third side, having the second length, and connected to the first side, and the at least one antenna structure may include a first antenna structure (e.g., the first antenna structure 500 of FIG. 9) disposed at a first point adjacent to the first side, and a second antenna structure (e.g., the second antenna structure 500-1 of FIG. 9) disposed at a second point adjacent to the third side and diagonally symmetrical to the first point.

According to various embodiments, the electronic device may further include a display (e.g., the display 301 of FIG. 7) disposed to be at least partially visible from the outside through the first cover in the internal space.

An example 1 of the present disclosure may be device with a housing (e.g., the housing 310 of FIG. 7) including a side member (e.g., the side member 320 of FIG. 7) including a conductive member (e.g., the conductive member 321 of FIG. 7) and a non-conductive member (e.g., the non-conductive member 322 of FIG. 7) coupled with the conductive member; and at least one antenna structure (e.g., the antenna structure 500 of FIG. 7) disposed in an internal space of the housing and including a substrate (e.g., the substrate 590 of FIG. 7) and at least one antenna element (e.g., the array antenna AR1 of FIG. 7), the substrate being disposed to face the side member, and the at least one antenna element being disposed on the substrate and including a beam pattern formed through the non-conductive member in a direction in which the side member faces, wherein: when the side member is viewed from the outside, a boundary region between the conductive member and the non-conductive member is disposed in a region not overlapping the substrate; in the boundary region, the conductive member includes at least one concave part (e.g., the concave part 3221 of FIG. 8) formed to at least partially receive the non-conductive member; and the at least one concave part includes two or more stepped parts (e.g., the stepped parts 3221*a*, 3221*b*, and 3221*c* of FIG. 8) which gradually get higher or lower as the stepped parts are further leftward or rightward from the substrate, when the side member is viewed from the outside.

An example 2 may be a device in accordance with example 1, or with any other example described herein, wherein the housing comprises a first cover; a second cover facing in a direction opposite to the first cover; and the side member surrounding the internal space between the first cover and the second cover, and wherein when the side member is viewed from the outside, the two or more stepped parts are formed to gradually get higher as the stepped parts are further leftward or rightward from the substrate and become closer to the second cover.

An example 3 may be a device in accordance with example 1 or example 2, or with any other example described herein, wherein the device further comprises a wireless communication circuit disposed in the internal space and configured to transmit and/or receive a wireless signal in a range of about 3 GHz to 100 GHz through the at least one antenna element.

An example 4 may be a device in accordance with any one of examples 1 to 3, or with any other example described herein, wherein the wireless communication circuit is mounted on the substrate.

An example 5 may be a device in accordance with any one of examples 1 to 4, or with any other example described herein, wherein the at least one concave part is formed such that an angle formed by a first virtual line formed by the two or more stepped parts, and a second virtual line formed perpendicularly in an outward direction of the side member from an end of the substrate has a range of about 30° to 60°.

An example 6 may be a device in accordance with any one of examples 1 to 5, or with any other example described herein, wherein the side member further comprises at least one through-hole which is formed in at least a portion of a region facing the first cover, and through which the non-conductive member is disposed to extend.

An example 7 may be a device in accordance with any one of examples 1 to 6, or with any other example described herein, wherein a total length of the at least one through-hole is formed to be shorter than, the same as, or longer than a total length of the non-conductive member.

An example 8 may be a device in accordance with any one of examples 1 to 7, or with any other example described herein, wherein at least a portion of the beam pattern is formed through the at least one through-hole.

An example 9 may be a device in accordance with any one of examples 1 to 8, or with any other example described herein, wherein a number of the at least one through-hole is determined by at least one conductive connection part connected to cross the through-hole.

An example 10 may be a device in accordance with any one of examples 1 to 9, or with any other example described herein, wherein the device further comprises at least one flange which at least partially extends from an edge of the at least one through-hole in a central direction of the through-hole.

An example 11 may be a device in accordance with any one of examples 1 to 10, or with any other example described herein, wherein the at least one flange is formed to have a thickness equal to or smaller than that of the conductive member.

An example 12 may be a device in accordance with any one of examples 1 to 11, or with any other example described herein, wherein the at least one through-hole is disposed at a position facing the substrate.

An example 13 may be a device in accordance with any one of examples 1 to 12, or with any other example described herein, wherein the at least one through-hole is formed to have a length equal to or longer than that of the substrate.

An example 14 may be a device in accordance with any one of examples 1 to 13, or with any other example described herein, wherein the side member comprises another non-conductive member at least partially extending into the internal space.

An example 15 may be a device in accordance with any one of examples 1 to 14, or with any other example described herein, wherein the side member comprises a first side having a first length, a second side extending in a vertical direction from the first side and having a second length shorter than the first length, a third side extending parallel to the first side from the second side and having the first length, and a fourth side extending from the third side, having the second length, and connected to the first side, and wherein the at least one antenna structure comprises a first antenna structure disposed at a first point adjacent to the first side, and a second antenna structure disposed at a second point adjacent to the third side and diagonally symmetrical to the first point.

The scope of protection is defined by the appended independent claims. Further features are specified by the appended dependent claims. Example implementations can be realized comprising one or more features of any claim taken jointly and severally in any and all permutations.

The examples described in this disclosure include non-limiting example implementations of components corresponding to one or more features specified by the appended independent claims and these features (or their corresponding components) either individually or in combination may contribute to ameliorating one or more technical problems deducible by the skilled person from this disclosure.

Furthermore, one or more selected component of any one example described in this disclosure may be combined with one or more selected component of any other one or more example described in this disclosure, or alternatively may be combined with features of an appended independent claim to form a further alternative example.

Further example implementations can be realized comprising one or more components of any herein described implementation taken jointly and severally in any and all permutations. Yet further example implementations may also be realized by combining features of one or more of the appended claims with one or more selected components of any example implementation described herein.

In forming such further example implementations, some components of any example implementation described in this disclosure may be omitted. The one or more components that may be omitted are those components that the skilled person would directly and unambiguously recognize as being not, as such, indispensable for the function of the present technique in the light of a technical problem discernible from this disclosure. The skilled person would recognize that replacement or removal of such an omitted components does not require modification of other components or features of the further alternative example to compensate for the change. Thus further example implementations may be included, according to the present technique, even if the selected combination of features and/or components is not specifically recited in this disclosure.

Two or more physically distinct components in any described example implementation of this disclosure may alternatively be integrated into a single component where possible, provided that the same function is performed by the single component thus formed. Conversely, a single component of any example implementation described in this disclosure may alternatively be implemented as two or more distinct components to achieve the same function, where appropriate.

The invention claimed is:

1. An electronic device comprising:

a housing comprising a side member comprising a conductive member and a non-conductive member coupled with the conductive member; and at least one antenna structure disposed in an internal space of the housing and comprising a substrate and at least one antenna element, the substrate being disposed to face the side member, and the at least one antenna element being disposed on the substrate and including a beam pattern formed through the non-conductive member in a direction in which the side member faces, wherein when the side member is viewed from the outside, a boundary region between the conductive member and the non-conductive member is disposed in a region not overlapping the substrate, wherein, in the boundary region, the conductive member comprises at least one concave part formed to at least partially receive the non-conductive member, and wherein the at least one concave part comprises two or more stepped parts which gradually get higher or lower as the stepped parts are further leftward or rightward from the substrate, when the side member is viewed from the outside.

2. The electronic device of claim 1, wherein the housing comprises:

a first cover;

a second cover facing in a direction opposite to the first cover; and the side member surrounding the internal space between the first cover and the second cover, and wherein when the side member is viewed from the outside, the two or more stepped parts are formed to gradually get higher as the stepped parts are further leftward or rightward from the substrate and become closer to the second cover.

3. The electronic device of claim 1, further comprising a wireless communication circuit disposed in the internal space and configured to transmit and/or receive a wireless signal in a range of about 3 GHz to 100 GHz through the at least one antenna element.

4. The electronic device of claim 3, wherein the wireless communication circuit is mounted on the substrate.

5. The electronic device of claim 1, wherein the at least one concave part is formed such that an angle formed by a first virtual line formed by the two or more stepped parts, and a second virtual line formed perpendicularly in an outward direction of the side member from an end of the substrate has a range of about 30° to 60°.

6. The electronic device of claim 1, wherein the side member further comprises at least one through-hole which is formed in at least a portion of a region facing the first cover, and through which the non-conductive member is disposed to extend.

7. The electronic device of claim 6, wherein a total length of the at least one through-hole is formed to be shorter than, or longer than a total length of the non-conductive member.

8. The electronic device of claim 6, wherein at least a portion of the beam pattern is formed through the at least one through-hole.

9. The electronic device of claim 6, wherein a number of the at least one through-hole is determined by at least one conductive connection part connected to cross the through-hole.

10. The electronic device of claim 6, further comprising at least one flange which at least partially extends from an edge of the at least one through-hole in a central direction of the at least one through-hole.

11. The electronic device of claim 10, wherein the at least one flange is formed to have a thickness equal to or smaller than that of the conductive member.

12. The electronic device of claim 6, wherein the at least one through-hole is disposed at a position facing the substrate.

13. The electronic device of claim 12, wherein the at least one through-hole is formed to have a length equal to or longer than that of the substrate.

14. The electronic device of claim 1, wherein the side member comprises another non-conductive member at least partially extending into the internal space.

15. The electronic device of claim 1, wherein the side member comprises:

a first side having a first length, a second side extending in a vertical direction from the first side and having a second length shorter than the first length, a third side extending parallel to the first side from the second side and having the first length, and a fourth side extending from the third side, having the second length, and connected to the first side, and wherein the at least one antenna structure comprises:

a first antenna structure disposed at a first point adjacent to the first side, and a second antenna structure disposed at a second point adjacent to the third side and diagonally symmetrical to the first point.

* * * * *